US007284813B2

(12) United States Patent
Otsuki

(10) Patent No.: US 7,284,813 B2
(45) Date of Patent: Oct. 23, 2007

(54) PRINTER AND PRINTING SYSTEM

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/491,791

(22) PCT Filed: Mar. 13, 2003

(86) PCT No.: PCT/JP03/03013

§ 371 (c)(1),
(2), (4) Date: Feb. 8, 2005

(87) PCT Pub. No.: WO03/078165

PCT Pub. Date: Sep. 25, 2003

(65) Prior Publication Data

US 2005/0128237 A1 Jun. 16, 2005

(30) Foreign Application Priority Data

Mar. 18, 2002 (JP) ..... 2002-075033
Mar. 20, 2002 (JP) ..... 2002-078719
Mar. 20, 2002 (JP) ..... 2002-078720

(51) Int. Cl.
*B41J 29/393* (2006.01)
*B41J 29/38* (2006.01)

(52) U.S. Cl. ..... 347/19; 347/5

(58) Field of Classification Search ..... 347/5, 347/19

See application file for complete search history.

(56) References Cited

U.S. PATENT DOCUMENTS 6,158,837 A 12/2000 Hilton
6,416,152 B1 7/2002 Matsuzaki
7,008,125 B2 * 3/2006 Nunokawa et al. ..... 400/70
2002/0025185 A1 2/2002 Ito

FOREIGN PATENT DOCUMENTS

| | | | |
|---|---|---|---|
| EP | 1060895 | A1 * | 12/2000 |
| JP | 10-44512 | A | 2/1998 |
| JP | 11-320914 | A | 11/1999 |
| JP | 11-348375 | A | 12/1999 |
| JP | 2000-6440 | A | 1/2000 |
| JP | 2000-246921 | A | 9/2000 |
| JP | 2000-255080 | | 9/2000 |
| JP | 2000-255080 | A | 9/2000 |
| JP | 2000-301735 | A | 10/2000 |
| JP | 2001-22230 | A | 1/2001 |
| JP | 2001-143037 | | 5/2001 |
| JP | 2001-219552 | A | 8/2001 |
| JP | 2001-229358 | | 8/2001 |
| JP | 2001-308741 | | 11/2001 |
| JP | 2002-234192 | | 8/2002 |
| WO | WO 02/02337 | A1 | 1/2001 |
| WO | WO 02/053389 | A1 * | 7/2002 |

* cited by examiner

*Primary Examiner*—Julian D. Huffman
(74) *Attorney, Agent, or Firm*—Sughrue Mion, PLLC

(57) ABSTRACT

The present invention is a printing apparatus having: an antenna for communicating wirelessly with an element that is provided on an ink container; and an attach/detach section to and from which a storage medium can be attached and detached. The antenna is a flat antenna, the antenna is capable of communicating wirelessly with the storage medium attached to the attach/detach section, the medium is parallel to the antenna when the storage medium is attached to the attach/detach section, one side of the antenna faces the element, and the other side of the antenna faces the storage medium attached to the attach/detach section.

13 Claims, 25 Drawing Sheets

FIG.4
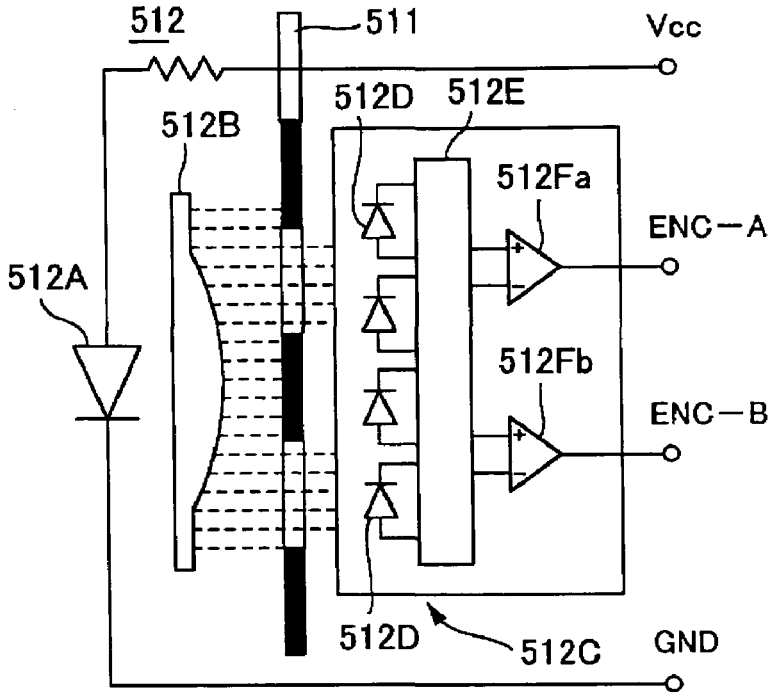
FIG.5
FIG.5A
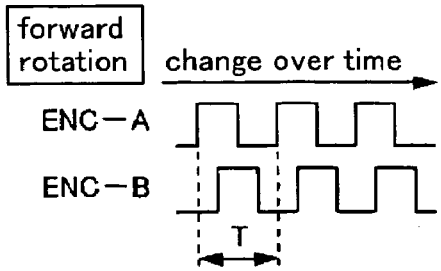
FIG.5B
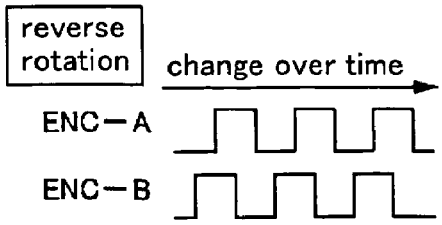

FIG.6
FIG.6A
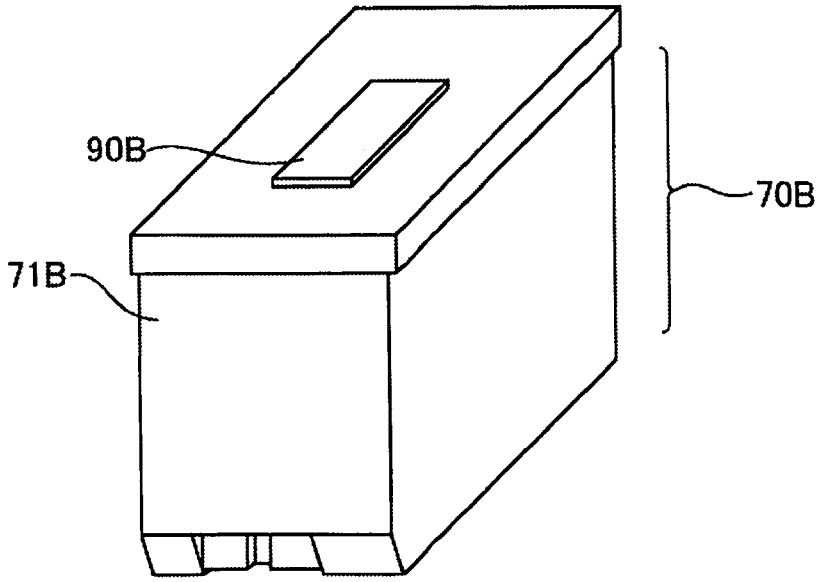
FIG.6B
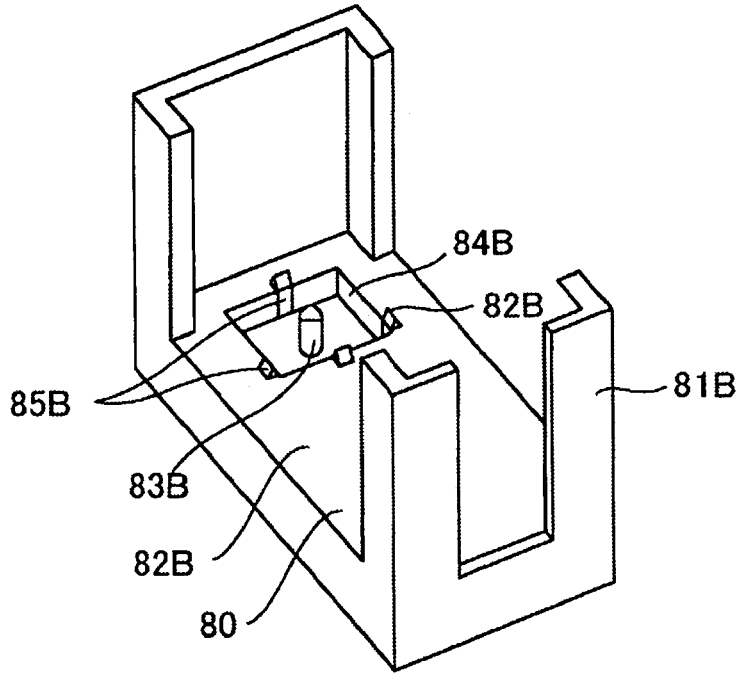

FIG.8
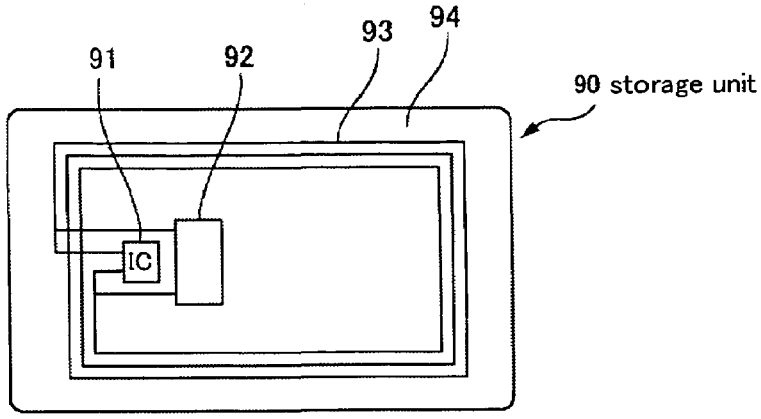
FIG.8A
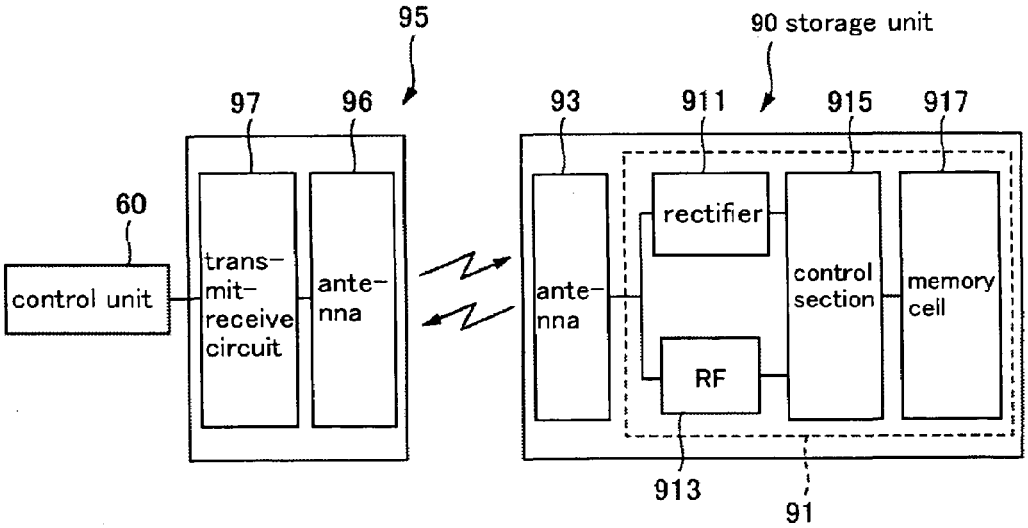
FIG.8B

FIG.10
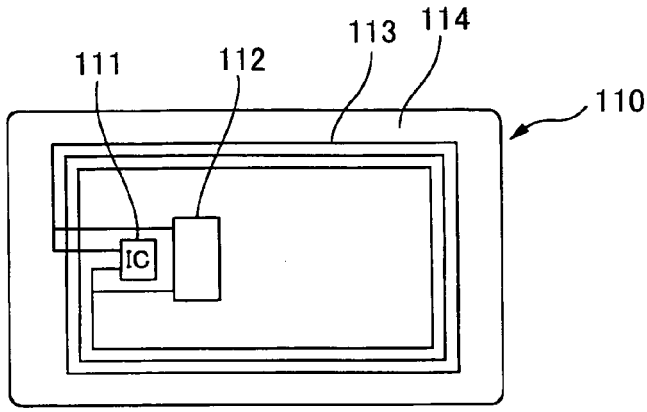
FIG.10A
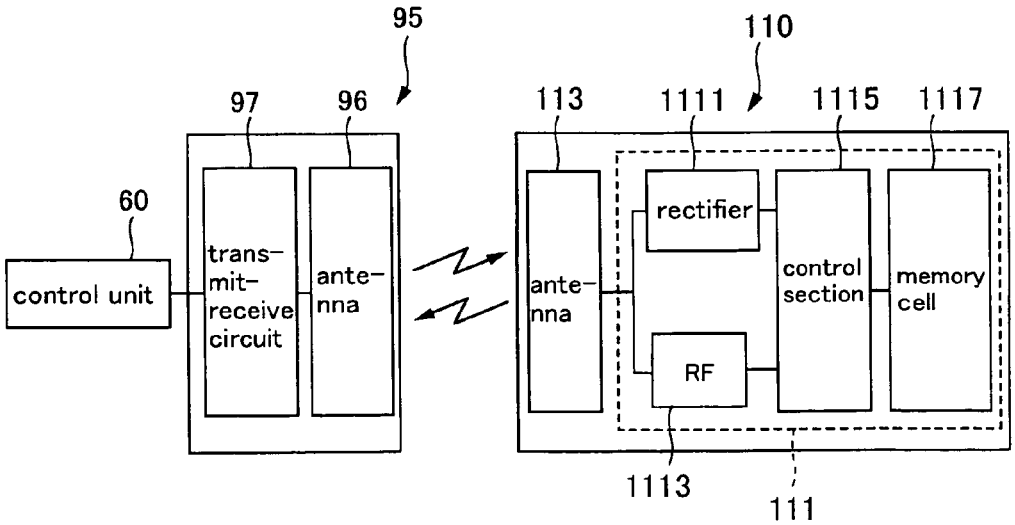
FIG.10B

FIG.20
FIG.20A
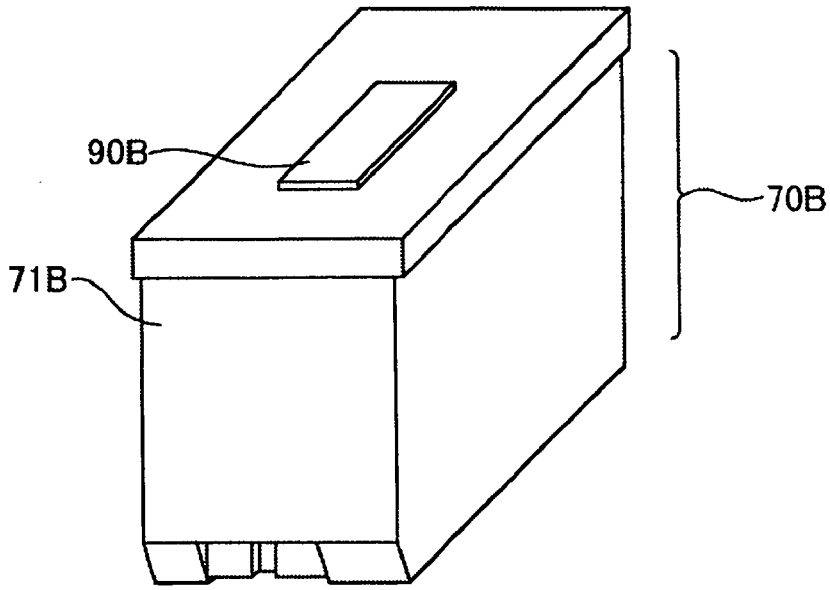
FIG.20B
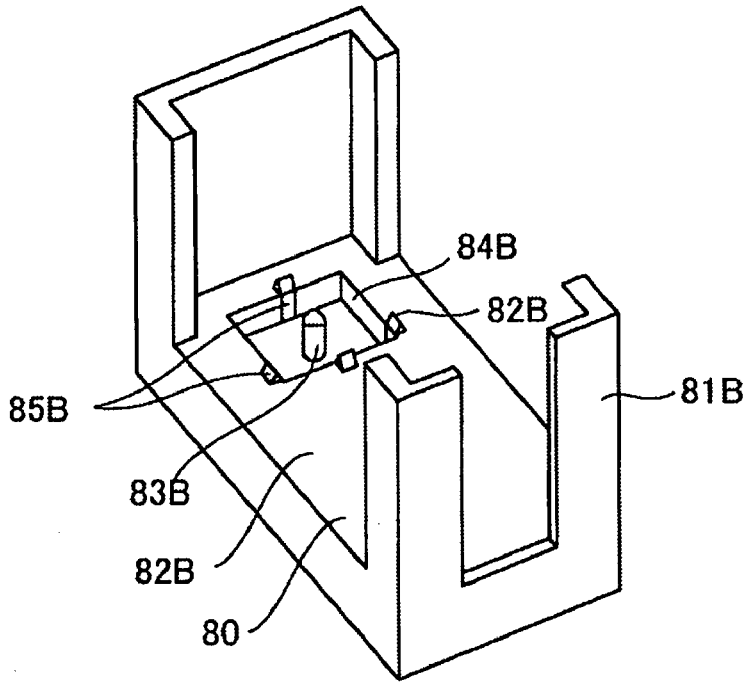

PRINTER AND PRINTING SYSTEM

TECHNICAL FIELD

The present invention relates to printing apparatuses for printing on a medium to be printed such as paper. The present invention also relates to printing systems that comprise such printing apparatuses.

Further, the present application claims priority on Japanese Patent Application No. 2002-75033 filed on Mar. 18, 2002, Japanese Patent Application No. 2002-78719 filed on Mar. 20, 2002, and Japanese Patent Application No. 2002-78720 filed on Mar. 20, 2002, which are herein incorporated by reference.

BACKGROUND ART

Various types of printers are known as printing apparatuses for printing on various kinds of media to be printed such as paper, cloth, and film. These printers widely adopt the cartridge style in which ink is contained in an ink container and is made attachable/detachable.

For such cartridge-style printers, a method of providing a memory on the cartridge in order to monitor, for example, the amount of ink remaining in the cartridge is known. Further, information is appropriately written into or read out from this memory.

However, when writing into or reading out from the memory provided on the cartridge, if a contact-type connector has to be used, the durability of the contact section becomes a problem.

(1) In view of the above, in the present invention, an antenna is used to carry out wireless communication with an element (for example, a storage unit having a memory) provided on the ink container (for example, a cartridge). The first invention has an object of providing a printing apparatus which effectively utilizes this antenna.

(2) Further, when communication is to be carried out wirelessly, it is preferable to be able to communicate with a weak radio wave. The second invention has an object of providing a power-conserving printer by establishing a state in which communication is possible even with a weak radio wave.

DISCLOSURE OF INVENTION

A first aspect of the present invention is a printing apparatus having: an antenna for communicating wirelessly with an element that is provided on an ink container; and an attach/detach section to and from which a storage medium can be attached and detached, wherein:

the antenna is a flat antenna;

the antenna is capable of communicating wirelessly with the storage medium attached to the attach/detach section;

the medium is parallel to the antenna when the storage medium is attached to the attach/detach section;

one side of the antenna faces the element; and the other side of the antenna faces the storage medium attached to the attach/detach section.

A second aspect of the present invention has: a moving body to and from which an ink container can be attached and detached; and an antenna that is provided on the moving body and that is for reading and writing information wirelessly with respect to an element provided on the ink container, wherein when the ink container is attached to the moving body, the antenna presses the element.

It should be noted that it is also possible to perceive the present invention from other viewpoints. Other features of the present invention will be made clear by the attached drawings and the discussion in the present description.

BRIEF DESCRIPTION OF DRAWINGS

FIG. 4 is an explanatory diagram of a configuration of a linear encoder.

FIG. 5A is a timing chart showing waveforms of output signals when a CR motor is rotating forward. FIG. 5B is a timing chart showing waveforms of output signals when the CR motor is rotating in reverse.

FIG. 6A is a schematic diagram showing a structure of a cartridge. FIG. 6B is a schematic diagram of a frame.

FIG. 8A is a plan perspective view showing a structure of a storage unit. FIG. 8B is a block diagram for explaining an internal structure of the storage unit and a transmit-receive section.

FIG. 10A is a plan perspective view showing a structure of a memory card. FIG. 10B is a block diagram for explaining an internal structure of the memory card and the transmit-receive section.

FIG. 20A is a schematic diagram showing a structure of the cartridge. FIG. 20B is a schematic diagram of an attach/detach section.

DESCRIPTION OF REFERENCE CHARACTERS

Figure 1:
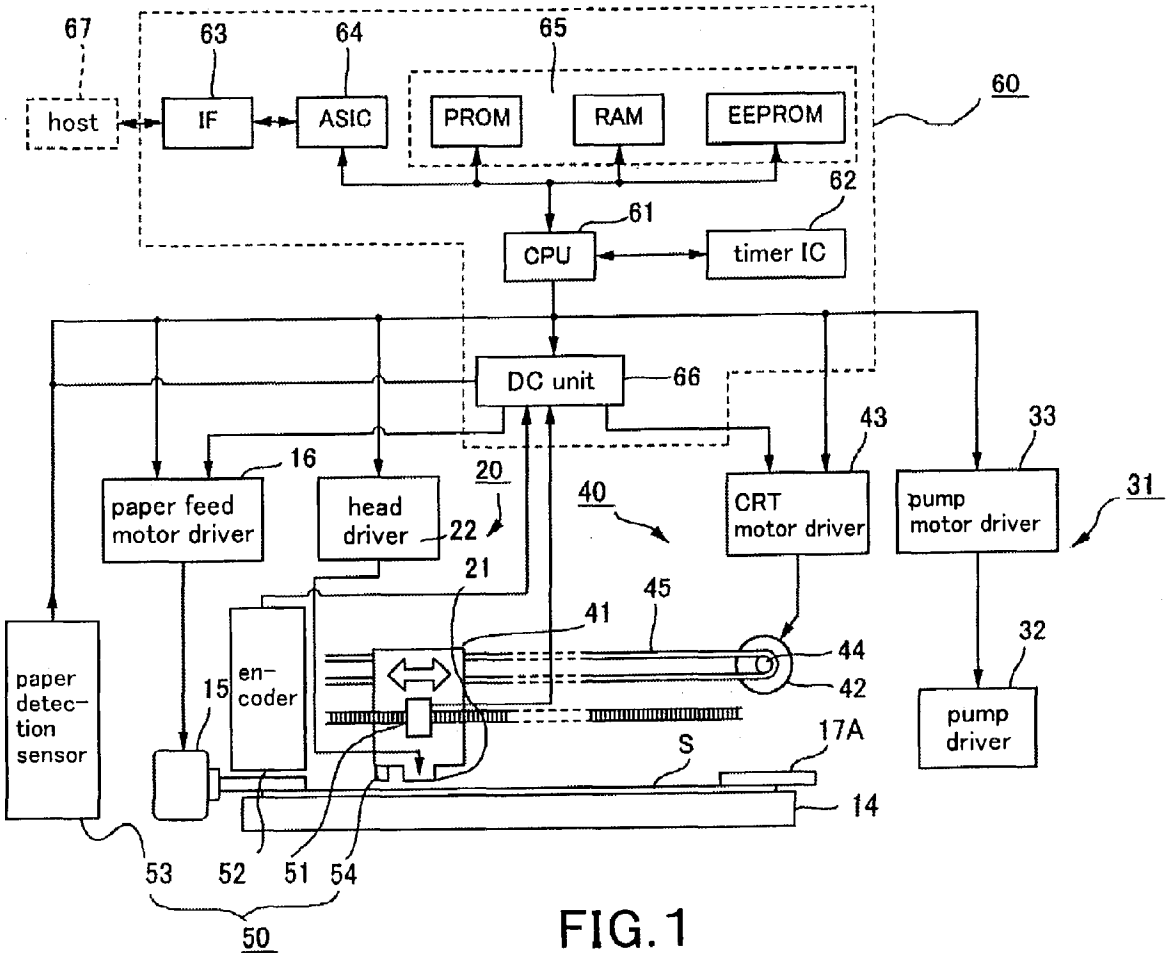
FIG. 1 is an explanatory diagram of an overall configuration of an inkjet printer according to the present embodiment.

1 printer, 3 housing, 5 top lid, 7 operating section, 10 paper carrying unit, 11A paper-supply insertion opening, 11B paper discharge opening, 12 paper supply motor, 13 paper supply roller, 14 platen, 15 paper feed motor (PF motor), 16 paper feed motor driver (PF motor driver), 17A paper feed roller, 17B paper discharge rollers, 18A and 18B free rollers, 19A, 19B, and 19C gears,

20 ink ejection unit, 21 head, 22 head driver, 30 cleaning unit, 31 pump device, 32 pump motor, 33 pump motor driver, 35 capping device,

40 carriage unit, 41 carriage, 42 carriage motor (CR motor), 43 carriage motor driver (CR motor driver), 44 pulley, 45 timing belt, 46 guide rail,

50 measuring instrument group, 51 linear encoder, 511 linear scale, 512 detection section, 512A light-emitting diode, 512B collimating lens, 512C detection processing section, 512D photodiodes, 512E signal processing circuit, 512F comparators, 52 rotary encoder, 53 paper detection sensor,

60 control unit, 61 CPU, 62 timer, 63 interface section, 64 ASIC, 65 memory, 66 DC controller, 67 host computer, 70 cartridge, 71 body, 72 ink containing section, 73 ink supply opening,

80 frame (attach/detach section), 81 retaining section, 82 bottom section, 83 needle, 84 recessed section, 85 guides, 86 fixing tool, 87 lid, 88 rotation shaft, 89 clamping tool,

90 storage unit, 91 IC chip, 911 rectifier, 913 signal analysis section RF, 915 control section, 917 memory cell, 92 capacitor, 93 antenna, 94 film, 95 transmit-receive section,

96 antenna, 97 transmit-receive circuit,

100 slot,

110 memory card, 111 IC chip, 1111 rectifier, 1113 signal analysis section RF, 1115 control section, 1117 memory cell, 112 capacitor, 113 antenna, 114 film,

200 package, 210 paper, 220 packaging means

BEST MODE FOR CARRYING OUT THE INVENTION

At least the following matters will be made clear by the discussion in the present description and the accompanying drawings.

A printing apparatus comprises: an antenna for communicating wirelessly with an element that is provided on an ink container; and an attach/detach section to and from which a storage medium can be attached and detached, wherein:

the antenna is a flat antenna;

the antenna is capable of communicating wirelessly with the storage medium attached to the attach/detach section;

the medium is parallel to the antenna when the storage medium is attached to the attach/detach section;

one side of the antenna faces the element; and the other side of the antenna faces the storage medium attached to the attach/detach section.

According to such a printing apparatus, the antenna is capable of communicating not only with the element that is provided on the ink container, but is also capable of communicating with the storage medium that is set on the attach/detach section, thus it is possible to effectively use the antenna. In short, one feature is to utilize the characteristic that the antenna generates a magnetic field not only in the direction of the element provided on the ink container, but also in other directions. That is, according to such a printing apparatus, by utilizing the feature that the flat antenna generates a magnetic field on both sides, it is possible to communicate wirelessly with both the storage medium and the element. Further, since this flat antenna and the storage medium become parallel, wireless communication between the antenna and the storage medium is brought into a satisfactory state.

Further, in this printing apparatus, it is preferable that the antenna is provided on a lid which is opened and closed when the ink container is exchanged. According to such a printing apparatus, since the element and the antenna are brought into a state in which they do not face each other when the ink container is being exchanged, it is possible to make the exchange of the ink container easy.

Further, in this printing apparatus, it is preferable that the attach/detach section is provided on the lid. According to such a printing apparatus, since the attach/detach section is opened and closed with the lid, it is possible to make the exchange of the ink container easy.

Further, in this printing apparatus, it is preferable that the printing apparatus further comprises a moving body to and from which the ink container can be attached and detached; and the antenna is provided on a lid of the moving body. According to such a printing apparatus, since the antenna is capable of communicating with the element during printing and the distance between the element and the antenna is shortened, communication is possible even with a weak radio wave.

Further, in this printing apparatus, it is preferable that the material of the lid is a nonmagnetic material. According to such a printing apparatus, reliability of communication with the storage medium set on the attach/detach section is improved.

Further, in this printing apparatus, it is preferable that the attach/detach section is a nonmagnetic material. According to such a printing apparatus, reliability of communication with the storage medium set on the attach/detach section is improved.

Further, in this printing apparatus, it is preferable that the attach/detach section restricts the position of the storage medium. According to such a printing apparatus, the position of the storage medium is restricted, and thus, reliability of communication with the storage medium is improved.

In this printing apparatus, it is preferable that the attach/detach section is a slot for inserting the storage medium. According to such a printing apparatus, the position of the inserted storage medium is restricted, and thus, reliability of communication with the storage medium is improved.

Further, in this printing apparatus, the printing apparatus further comprises a unit for preventing clogging of nozzles that eject ink; and the antenna is provided above the unit. According to such a printing apparatus, the antenna is capable of communicating with the element during the operation of preventing clogging of the nozzles.

Further, in this printing apparatus, it is preferable that the antenna is provided above a region where printing is carried out on a medium to be printed. According to such a printing apparatus, the antenna is capable of communicating with the element during printing operations.

Further, in this printing apparatus, it is preferable that the antenna communicates information about an amount of ink with the element. According to such a printing apparatus, the antenna can write, into the element, information about the ink amount in real time during printing operations.

Further, in this printing apparatus, it is preferable that the antenna communicates information about a medium to be printed with the storage medium. According to such a printing apparatus, the printing apparatus can obtain information about the medium to be printed via the antenna.

Note that, in this printing apparatus, it is possible that conditions for the printing operation are set up based on the information about the medium to be printed. According to such a printing apparatus, since it is possible to carry out printing in compliance with the medium to be printed, high-precision printing can be carried out. Further, in this printing apparatus, the conditions for the printing operation may be a condition about the timing for ejecting ink or a condition about an amount of ink ejection. According to such a printing apparatus, high precision printing can be carried out.

Further, in this printing apparatus, it is preferable that the storage medium is packaged together with the medium to be printed; and when the printing apparatus prints on the medium to be printed, the storage medium is taken out independently of the medium to be printed and attached to the attach/detach section. By using a package which packages such a storage medium and such a medium to be printed, the setup that suits the medium to be printed can be made using the information stored in the storage medium, and the setup operation can be made easier.

Further, in this printing apparatus, it is preferable that the antenna communicates, with the storage medium, information about a location where driver information for the medium to be printed can be downloaded from. According to such a printing apparatus, a setup based on the latest information can be made easily.

Note that, in this package, it is preferable that the storage medium stores information for identifying the medium to be printed. According to such a package, it is possible to perform a printer setup that suits the medium to be printed.

Further, in this package, it is preferable that the storage medium stores information about the kind of medium to be printed. According to such a package, the printer setup can easily be performed according to the kind of medium to be printed.

Further, in this package, it is preferable that the storage medium stores information about the size of the medium to be printed. According to such a package, the printer setup can easily be performed according to the size of the medium to be printed.

Further, in this package, it is preferable that the storage medium stores information about the thickness of the medium to be printed. According to such a package, the printer setup can easily be performed according to the thickness of the medium to be printed.

Further, in this package, it is preferable that the storage medium stores information about the color correction for printing on the medium to be printed. According to such a package, the color correction setup for printing on the medium to be printed can easily be performed.

Further, in this package, it is preferable that the storage medium stores information about when the medium to be printed was manufactured. According to such a package, the printer setup can easily be performed according to when the medium to be printed was manufactured.

Further, in this package, it is preferable that the storage medium stores information about the print conditions of the medium to be printed. According to such a package, the print conditions of the medium to be printed can easily be set up.

Further, in this package, it is preferable that the storage medium can communicating wirelessly. According to such a package, the printer setup can be made easy through non-contact communication.

Further, in this package, it is preferable that the storage medium has a flat antenna. According to such a package, the storage medium can be made flat.

Further, in this package, it is preferable that the storage medium has a contact point for connecting to a connector. According to such a package, it is possible to communicate with the storage medium by bringing the connector into contact with the storage medium.

Further, in this package, it is preferable that the storage medium has a mark for indicating the direction of the storage medium. According to such a package, the storage medium can be correctly attached to the printer.

A printing system comprises: a computer; and a printing apparatus that is connected to the computer and that includes an antenna for communicating wirelessly with an element that is provided on an ink container, and an attach/detach section to and from which a storage medium can be attached and detached, wherein:

the antenna is a flat antenna;

one side of the antenna faces the element;

the medium is parallel to the antenna when the storage medium is attached to the attach/detach section;

the other side of the antenna faces the storage medium attached to the attach/detach section; and the antenna is capable of communicating wirelessly with the storage medium attached to the attach/detach section.

According to such a computer system, it is possible to provide an inexpensive and space-saving system through a printing apparatus that effectively uses an antenna.

A printing apparatus comprises: a moving body to and from which an ink container can be attached and detached; and an antenna that is provided on the moving body and that is for communicating wirelessly with an element provided on the ink container, wherein when the ink container is attached to the moving body, the antenna presses the element.

According to such a printing apparatus, since the distance between the element and the antenna becomes short, communication becomes possible even with a weak radio wave. Note that, according to such a printing apparatus, since the antenna is provided on the moving body, it becomes possible to communicate wirelessly with the element provided on the ink container, even while the ink container is being moved by the moving body.

In this printing apparatus, it is preferable that, when the ink container is attached to the moving body, a member that covers the antenna comes into contact with a member that covers the element. According to such a printing apparatus, since the distance between the element and the antenna becomes short, communication becomes possible even with a weak radio wave.

In this printing apparatus, it is preferable that the antenna is arranged on a lid that is provided on the moving body for covering the ink container that has been attached. According to such a printing apparatus, since the element and the antenna face each other when the lid is closed, communication becomes possible even with a weak radio wave.

In this printing apparatus, it is preferable that the moving body has a frame that forms a space for attaching the ink container; and the antenna is arranged on an inner side of the frame. According to such a printing apparatus, when the ink container is attached to the moving body, the antenna and the element provided on the ink container can face each other.

In this printing apparatus, it is preferable that the moving body is capable of receiving a plurality of the ink containers; and a plurality of the antennas are provided on the moving body in such a manner that each antenna corresponds to the element provided on each of the ink containers. According to such a printing apparatus, it is possible to communicate with a plurality of elements using a plurality of antennas, and it is possible to establish a one-to-one correspondence between the antennas and the elements.

In this printing apparatus, it is preferable that the moving body is capable of receiving a plurality of the ink containers; and the antenna is capable of communicating wirelessly with a plurality of the elements. According to such a printing apparatus, since the antenna can be made large, the signal to be transmitted and received can be made large, and thus reliability of communication can be improved. Further, according to such a printing apparatus, since the number of antennas can be reduced, manufacturing costs can be reduced.

Note that, in this printing apparatus, the element and the antenna may be arranged to face each other. According to such a printing apparatus, communication becomes possible even with a weak radio wave.

Further, in this printing apparatus, the antenna may be able to communicate wirelessly with the ink container when printing is being carried out on a medium to be printed. According to such a printing apparatus, information during printing can be communicated in real time.

Further, in this printing apparatus, the element may store information about ink in the ink container. According to such a printing apparatus, the attachable/detachable ink container can hold information about ink.

Further, in this printing apparatus, the element may store information about the amount of ink in the ink container. According to such a printing apparatus, even if the power is suddenly turned off and the ink container is exchanged, the ink container can hold accurate information about the ink remaining amount.

Further, the printing apparatus may comprise a moving body to and from which a toner container can be attached and detached and an antenna which communicates wirelessly with the element provided on the toner container, and this printing apparatus may be characterized in that the antenna is provided on the moving body. According to such a printing apparatus, even while the toner container is moving with the moving body, wireless communication can be carried out with the element provided on the toner container.

Further, it may be a program that is characterized in causing a printing apparatus, which includes a moving body to and from which an ink container can be attached and detached and an antenna that is provided on the moving body and that is for communicating wirelessly with an element provided on the ink container, to achieve a function for the antenna to communicate wirelessly with the element provided on the ink container while the moving body is moving. According to such a program, even while the ink container is being moved by the moving body, the printing apparatus can be controlled to be able to communicate wirelessly with the element provided on the ink container.

A printing system comprises: a computer; and a moving body that is connected to the computer and to and from which an ink container can be attached and detached, and an antenna that is provided on the moving body and that is for communicating wirelessly with an element provided on the ink container, wherein when the ink container is attached to the moving body, the antenna presses the element.

According to such a printing system, since the distance between the element and the antenna becomes short, communication becomes possible even with a weak radio wave. Note that, according to such a printing system, since the antenna is provided on the moving body, it becomes possible to communicate wirelessly with the element provided on the ink container, even while the ink container is being moved by the moving body.

Note that, other than such printing apparatuses, a carry amount correction pattern, a program, a computer system, and a printing method will be explained.

1. First Embodiment

Overview of Printing Apparatus (Inkjet Printer)

<About the Configuration of Inkjet Printer>

Figure 2:
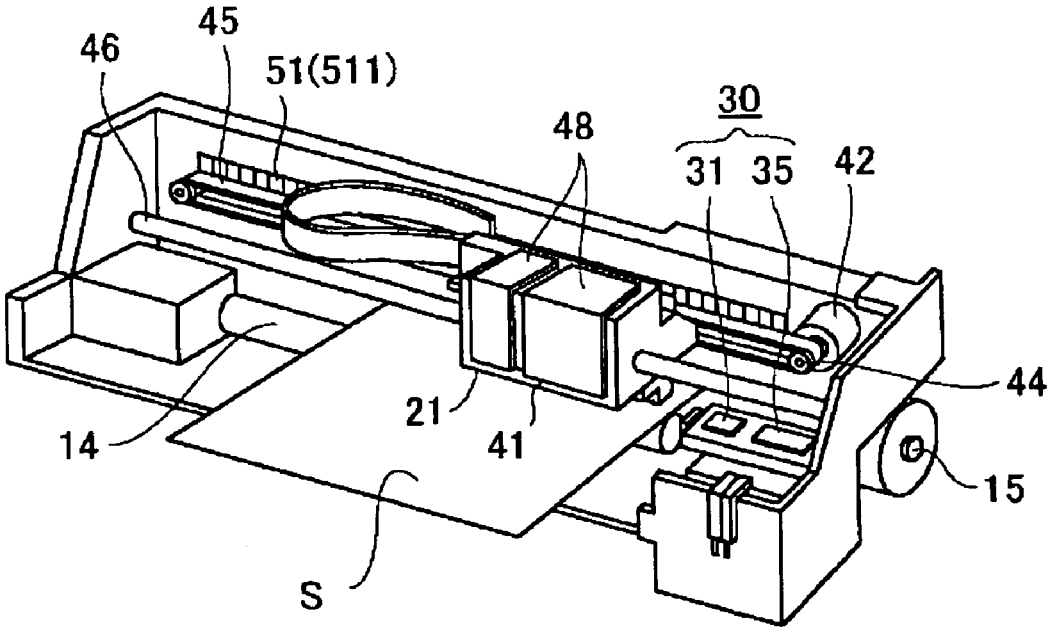
FIG. 2 is a schematic diagram of the periphery of a carriage of the inkjet printer according to the present embodiment.
Figure 3:
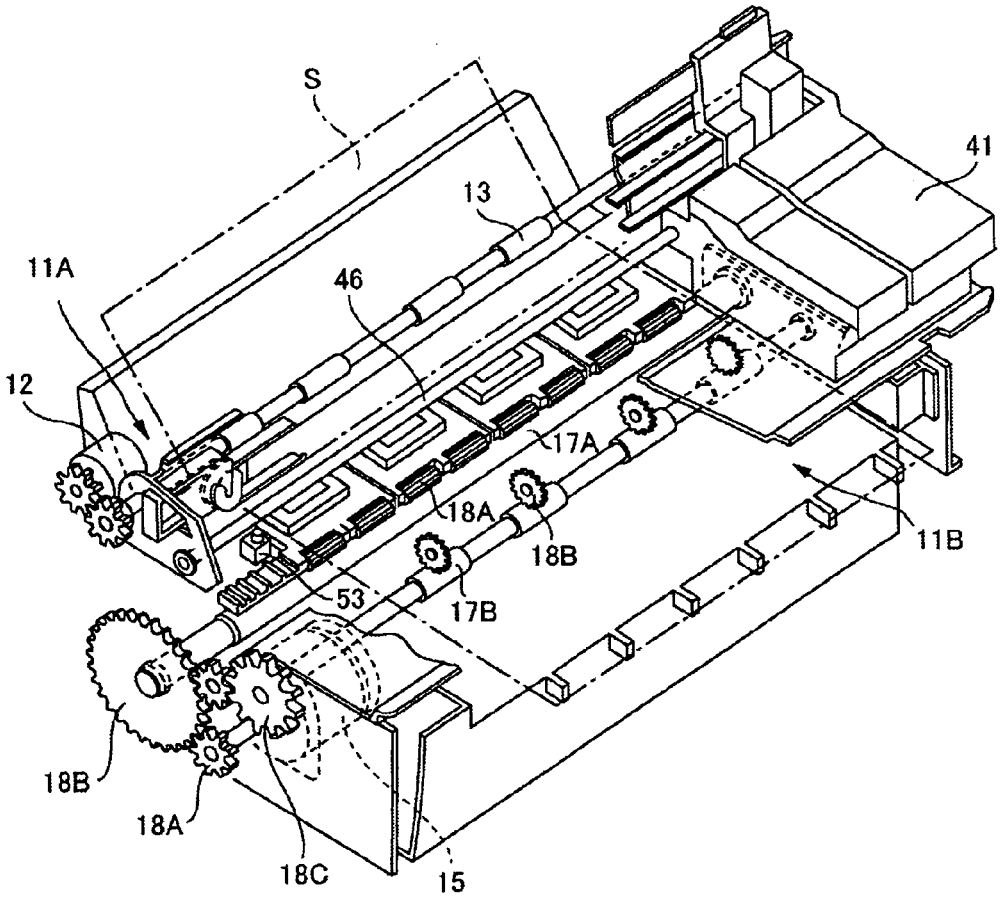
FIG. 3 is an explanatory diagram of the periphery of a carrying unit of the inkjet printer according to the present embodiment.

An overview of an inkjet printer serving as an example of a printing apparatus is described with reference to FIG. 1, FIG. 2, and FIG. 3. Note that FIG. 1 is an explanatory diagram of an overall configuration of an inkjet printer of this embodiment. FIG. 2 is a schematic diagram of the periphery of a carriage of the inkjet printer of this embodiment. FIG. 3 is an explanatory diagram of the periphery of a carrying unit of the inkjet printer of this embodiment.

The inkjet printer of this embodiment has a paper carrying unit 10, an ink ejection unit 20, a cleaning unit 30, a carriage unit 40, a measuring instrument group 50, and a control unit 60.

The paper carrying unit 10 is for feeding paper, which is an example of a medium to be printed, to a printable position and making the paper move, during printing, in a predetermined direction (in FIG. 1, the direction perpendicular to the paper face (hereinafter, this is referred to as the paper feed direction)) by a predetermined amount of movement. The paper carrying unit 10 has a paper-supply insertion opening 11A, a paper discharge opening 11B, a paper supply motor 12, a paper supply roller 13, a platen 14, a paper feed motor (hereinafter, referred to as PF motor) 15, a paper feed motor driver (hereinafter, referred to as PF motor driver) 16, a paper feed roller 17A, paper discharge rollers 17B, free rollers 18A, free rollers 18B, a gear 19A, a gear 19B, and a gear 19C. The paper-supply insertion opening 11 is an inserting section where paper, which is a medium to be printed, is inserted. The paper supply motor 12 is a motor for carrying the paper that has been inserted into the paper-supply insertion opening 11 into the printer, and is made up of a DC motor. The paper supply roller 13 is a roller for carrying the paper that has been inserted into the paper-supply insertion opening 11 into the printer, and is driven by the paper supply motor 12. The platen 14 supports the paper S during printing. The PF motor 15 is a motor for feeding paper, which is an example of a medium to be printed, in the paper feed direction, and is made up of a DC motor. The PF motor driver 16 is for driving the PF motor 15. The paper feed roller 17A is a roller for feeding the paper S that has been carried into the printer by the paper supply roller 13 to a printable region, and is driven by the PF motor 15. The free rollers 18A are provided in a position that is in opposition to the paper feed roller 17A, and push the paper S toward the paper feed roller 17A by sandwiching the paper S between them and the paper feed roller 17A. The paper discharge rollers 17B are rollers for discharging from the printer the paper S for which printing has finished. The free rollers 18B are provided in a position that is in opposition to the paper discharge rollers 17B, and push the paper S toward the paper discharge rollers 17B by sandwiching the paper S between them and the paper discharge rollers 17B. The gear 19A, the gear 19B, and the gear 19C are for transmitting the drive power of the PF motor 15 to the paper discharge rollers 17B in order to drive the paper discharge rollers 17B with the PF motor 15. The paper discharge opening 11B is where the paper, which has been printed, is discharged outside of the printer.

The ink ejection unit 20 is for ejecting ink onto paper, which is an example of the medium to be printed. The ink ejection unit 20 has a head 21 and a head driver 22. The head 21 has a plurality of nozzles, which are ink ejection sections, and ejects ink intermittently from each of the nozzles. The head driver 22 is for driving the head 21 in order to make the ink be ejected intermittently from the head.

The cleaning unit 30 is for preventing the nozzles of the head 21 from becoming clogged. The cleaning unit 30 has a pump device 31 and a capping device 35. The pump device is for extracting ink from the nozzles in order to prevent the nozzles of the head 21 from becoming clogged, and has a pump motor 32 and a pump motor driver 33. The pump motor 32 sucks out ink from the nozzles of the head 21. The pump motor driver 33 drives the pump motor 32. The capping device 35 is for sealing the nozzles of the head 21 when printing is not being performed (during standby) so that the nozzles of the head 21 are kept from becoming clogged.

The carriage unit 40 is for making the head 21 scan and move in a predetermined shifting direction (in FIG. 1, the left and right direction of the paper face (hereinafter, this is referred to as the scanning direction)). The carriage unit 40 has a carriage 41, a carriage motor (hereinafter, referred to as CR motor) 42, a carriage motor driver (hereinafter, referred to as CR motor driver) 43, a pulley 44, a timing belt 45, and a guide rail 46. The carriage 41 can be moved in the scanning direction, and the head 21 is fastened to it (and therefore, the nozzles of the head 21 intermittently eject ink as they are moved in the scanning direction). The carriage 41 has a frame (attach/detach section) which removably holds ink cartridges 70 that contains ink. The frame can removably hold cartridges for different colors (black cartridge 70B, cyan cartridge 70C, magenta cartridge 70M, and yellow cartridge 70Y). It should be noted that the cartridge 70 and the frame will be described later. The CR motor 42 is a motor for moving the carriage in the scanning direction, and is made up of a DC motor. The CR motor driver 43 is for driving the CR motor 42. The pulley 44 is attached to the rotation shaft of the CR motor 42. The timing belt 45 is driven by the pulley 44. The guide rail 46 guides the carriage 41 in the scanning direction.

The measuring instrument group 50 includes a linear encoder 51, a rotary encoder 52, a paper detection sensor 53, and a gap sensor 54. The linear encoder 51 is for detecting the position of the carriage 41. The rotary encoder 52 is for detecting the amount of rotation of the PF motor 15. Note that the configuration etc. of the encoders is discussed later. The paper detection sensor 53 is for detecting the position of the edge (front edge or rear edge) of the paper to be printed. The gap sensor 54 is for detecting the distance from the nozzle to the paper S.

The control unit 60 is for controlling the printer. The control unit 60 has a CPU 61, a timer 62, an interface section 63, an ASIC 64, a memory 65, and a DC controller 66. The CPU 61 is for carrying out the overall control of the printer, and sends control commands to the DC controller 66, the PF motor driver 16, the CR motor driver 43, the pump motor driver 32, and the head driver 22. The timer 62 periodically generates interrupt signals with respect to the CPU 61. The interface section 63 exchanges data with a host computer 67 provided outside the printer. The ASIC 64 controls, for example, the printing resolution or the drive waveforms of the head based on print information sent from the host computer 67 through the interface section 63. The memory 65 is for reserving, for example, an area for storing the programs for the ASIC 64 and the CPU 61 and a working storage, and has storage means such as a PROM, a RAM, and an EEPROM. The DC controller 66 controls the PF motor driver 16 and the CR motor driver 43 based on control commands sent from the CPU 61 and the output from the measuring instrument group 50.

<About the Configuration of Encoders>

FIG. 4 is an explanatory diagram of the linear encoder 51.

The linear encoder 51 is for detecting the position of the carriage 41, and has a linear scale 511 and a detection section 512.

The linear scale 511 is provided with slits at a predetermined spacing (for example, every 1/180 inch (1 inch=2.54 cm)), and is fastened to the printer unit.

The detection section 512 is provided in opposition to the linear scale 511, and is on the side of the carriage 41. The detection section 512 has a light-emitting diode 512A, a collimating lens 512B, and a detection processing section 512C. The detection processing section 512C is provided with a plurality of (for instance, four) photodiodes 512D, a signal processing circuit 512E, and two comparators 512F*a* and 512F*b*.

The light-emitting diode 512A emits light when a voltage Vcc is applied to it via resistors on both sides, and this light is incident on the collimating lens. The collimating lens 512B turns the light that is emitted from the light-emitting diode 512A into parallel light, and the parallel light is irradiated on the linear scale 511. The parallel light that has passed through the slits provided in the linear scale then passes through stationary slits (not shown) and is incident on the photodiodes 512D. The photodiodes 512D convert the incident light into electric signals. The electric signals that are output from the photodiodes are compared in the comparators 512F*a* and 512F*b*, and the results of these comparisons are output as pulses. The pulse ENC-A and the pulse ENC-B that are output from the comparators 512F*a* and 512F*b*are the output of the linear encoder 51.

FIG. 5 shows timing charts showing waveforms of two types of output signals of the linear encoder 51. FIG. 5A is a timing chart of the waveform of the output signals when the CR motor 42 is rotating forward. FIG. 5B is a timing chart of the waveform of the output signals when the CR motor 42 is rotating in reverse.

As shown in FIG. 5A and FIG. 5B, the phases of the pulse ENC-A and the pulse ENC-B are misaligned by 90 degrees both when the CR motor 42 is rotating forward and when it is rotating in reverse. When the CR motor 42 is rotating forward, that is, when the carriage 41 is moving in the main-scanning direction, then, as shown in FIG. 5A, the phase of the pulse ENC-A leads the phase of the pulse ENC-B by 90 degrees. On the other hand, when the CR motor 42 is rotating in reverse, then, as shown in FIG. 5B, the phase of the pulse ENC-A is delayed by 90 degrees with respect to the phase of the pulse ENC-B. A single period T of the pulses is equivalent to the time during which the carriage 41 moves by the spacing of the slits of the linear scale 511 (which is, for example, 1/180 inch (1 inch=2.54 cm)).

The position of the carriage 41 is detected as follows. First, the rising edge or the falling edge of either the pulse ENC-A or ENC-B is detected, and the number of detected edges is counted. The position of the carriage 41 is calculated based on the counted number. As regards the counted number, when the CR motor 42 is rotated forward, then for each detected edge a "+1" is added, and when the CR motor 42 is rotating in reverse, then for each detected edge a "−1" is added. Because the period of the pulses ENC is equal to the slit spacing of the linear scale 511, by multiplying the counted number by the slit spacing, the amount of movement of the carriage 41 from where it was positioned when the count number was "0" can be obtained. In other words, the resolution of the linear encoder 51 in this case becomes the slit spacing of the linear scale 511. It is also possible to detect the position of the carriage 41 using both the pulse ENC-A and the pulse ENC-B. The periods of the pulse ENC-A and the pulse ENC-B are equal to the slit spacing of the linear scale 511, and the phases of the pulses ENC-A and ENC-B are misaligned by 90 degrees, and therefore, if the rising edges and the falling edges of the pulses are detected and the number of detected edges is counted, then a counted number of "1" corresponds to ¼ of the slit spacing of the linear scale 511. Therefore, if the count number is multiplied by ¼ of the slit spacing, then the amount of movement of the carriage 41 from where it was positioned when the count number was "0" can be obtained. That is, the resolution of the linear encoder 51 in this case is ¼ the slit spacing of the linear scale 511.

The velocity Vc of the carriage 41 is detected as follows. First, the rising edges or the falling edges of either the pulse ENC-A or ENC-B are detected. The time interval between edges of the pulses is counted with a timer counter. The period T (T=T1, T2, . . . ) is obtained from the value that is counted. Then, when the slit spacing of the linear scale 511 is regarded as λ, the velocity of the carriage can be sequentially found as λ/T. It is also possible to detect the velocity of the carriage 41 using both the pulse ENC-A and the pulse ENC-B. By detecting the rising edges and the falling edges of the pulses, the time interval between edges, which corresponds to ¼ of the slit spacing of the linear scale 511, is counted by a timer counter. The period T (T=T1, T2, . . . ) is obtained from the value that is counted. Then, when the slit spacing of the linear scale 511 is regarded as λ, the velocity Vc of the carriage can be sequentially found as Vc=λ/(4T).

Note that the rotary encoder 52 has substantially the same configuration as the linear encoder 51, except that a rotating disk that rotates in conjunction with rotation of the PF motor 15 is used in place of the linear scale 511 of the linear encoder 51.

Configuration of Cartridge and Frame (Attach/Detach Section)

The basic configurations of each of the above-described cartridges 70 for each color are the same. In view of this, the structure of a cartridge 70B for black ink and the structure of a frame 80B (attach/detach section) on which the cartridge 70B is mounted are explained with reference to FIG. 6 and FIG. 7.

FIG. 6A is a schematic diagram showing a structure of the cartridge 70B for black ink. FIG. 6B is a schematic diagram of the frame 80B where the cartridge 70B can be attached/detached. Further, FIG. 7 is a sectional view showing an internal structure of the cartridge 70B, an internal structure of the frame 80B provided on the carriage, and a state in which the cartridge 70B is mounted on the frame 80B.

Figure 7:
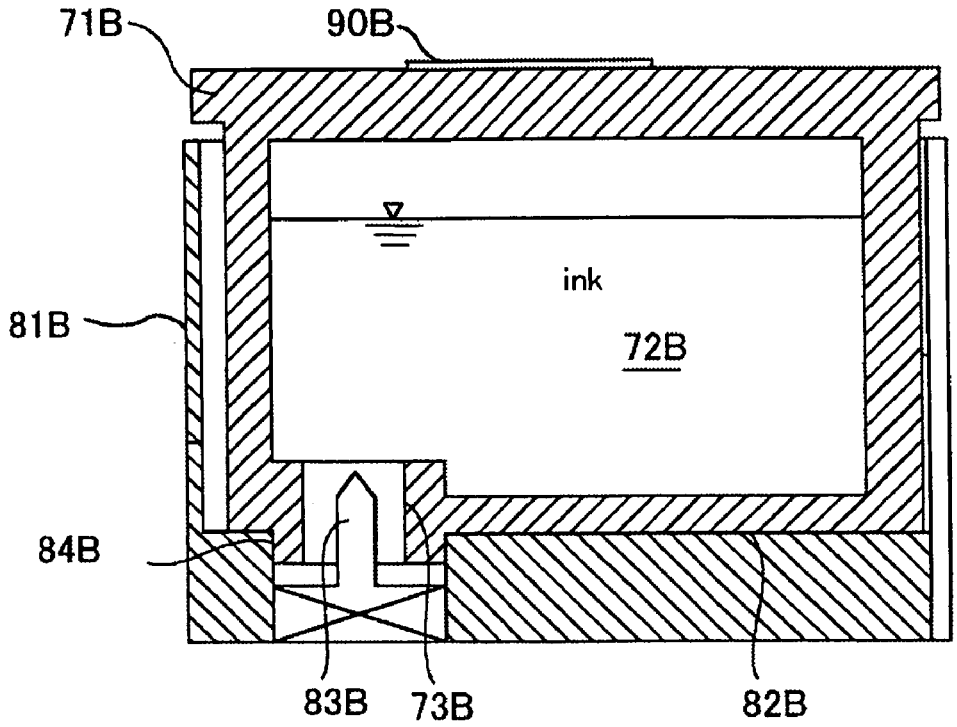
FIG. 7 is a sectional view showing an internal structure of the cartridge, an internal structure of the frame, and the state when the cartridge is mounted on the frame.

In FIG. 6A and FIG. 7, the cartridge 70B has a body 71B and a storage unit 90B. The body 71B comprises an ink containing section 72B, which contains black ink inside, and an ink supply opening 73B, and is formed of synthetic resin. The storage unit 90B is provided on an upper surface of the cartridge 70B. The reason why the storage unit 90B is provided on the upper surface of the cartridge 70B will become clear later on. Further, the structure of the storage unit 90B will be described later.

In FIG. 6B and FIG. 7, the frame 80B comprises a retaining section 81B, a bottom section 82B, a needle 83B, a recessed section 84B, and guides 85B. The retaining section 81B is a section for retaining the cartridge 70B from the sides, and forms a space for mounting the cartridge 70B. The bottom section 82B is a section for supporting the cartridge 70B from below. The needle 83B is to be pierced into the ink supply opening 73B of the cartridge 70B, and ink can be supplied by piercing the needle 83B into the ink supply opening 73B. The recessed section 84B is for receiving the ink supply opening 73B of the cartridge 70B. The guides 85B are for guiding the ink supply opening 73B of the cartridge 70B into the recessed section, and are provided on inner walls of the recessed section 84B.

The cartridges 70 for the other colors and the frames 80 for these cartridges 70 have substantially the same structure as the above described black ink cartridge 70B and the frame 80B, and therefore, explanation will be omitted.

Configuration of Storage Unit

Next, referring to FIG. 8, a configuration of a storage unit 90 which is an element provided on a cartridge (ink container) is described along with a configuration for transmitting and receiving data. FIG. 8A is a plan perspective view showing a configuration of the storage unit 90. FIG. 8B is a block diagram for explaining internal structures of the storage unit 90 and the transmit-receive section 95.

The storage unit 90 has an IC chip 91, a capacitor 92, an antenna 93, and a film 94. The configuration of the IC chip 91 will be described later. The capacitor 92 is a resonant capacitor formed by etching a metal film. The antenna 93 is structured by a flat coil. The film 94 is for covering the IC chip 91, the capacitor 92, and the antenna 93, and is structured by an insulating plastic film.

The IC chip 91 has a rectifier 911, a signal analysis section RF (Radio Frequency) 913, a control section 915, and a memory cell 917. The rectifier rectifies a high-frequency magnetic field that the antenna 93 has captured to make it into a direct-current power source for driving each circuit in the IC chip. The memory cell 917 is a nonvolatile memory that is electrically readable/writable, such as NAND flash ROM, and it is possible to store information that has been written in as well as read out the stored information from the outside. The memory cell 917 stores information about the cartridge 70.

For example, the memory cell 917 stores information that is unique to the cartridge (for example, ID information such as a serial number of the cartridge 70). When the printer body reads out the information unique to the cartridge, it becomes possible for the printer body to identify each of the cartridges.

Further, for example, the memory cell 917 stores information about ink that the cartridge 70 contains (for example, information about the ink amount (for example, used amount or remaining amount of ink)). When the printer body reads out the used amount information or the remaining amount information of ink in the cartridge 70, then the printer body can give a warning to the user when the remaining amount of ink becomes small.

Further, other than the above information, the memory cell 917 may store, for example, data about the color of the cartridge 70, data about the manufacturing information of the cartridge 70, data about the expiration date of the cartridge 70, or data about color correction used when the printer body prints using the cartridge 70. When the printer body reads out such information, it becomes possible for the printer body to use this information and control the printing processes.

The transmit-receive section 95 has an antenna 96 and a transmit-receive circuit 97. The antenna 96 is covered by an insulating plastic film (not shown), as is the antenna 96 of the storage unit 90. The transmit-receive circuit 97 generates high-frequency signals, induces a high-frequency magnetic field via the antenna 96, and communicates wirelessly with the storage unit 90. The transmit-receive circuit 97 is connected to the control unit 60 and controlled by the control unit 60.

In this embodiment, the communication between the control unit on the printer body side and the storage unit provided on the cartridge is carried out wirelessly, and therefore, non-contact communication becomes possible. Therefore, as compared to a case of using contact-type connectors, the durability improves, and handling becomes easier.

Contents of Package

Figure 9A:
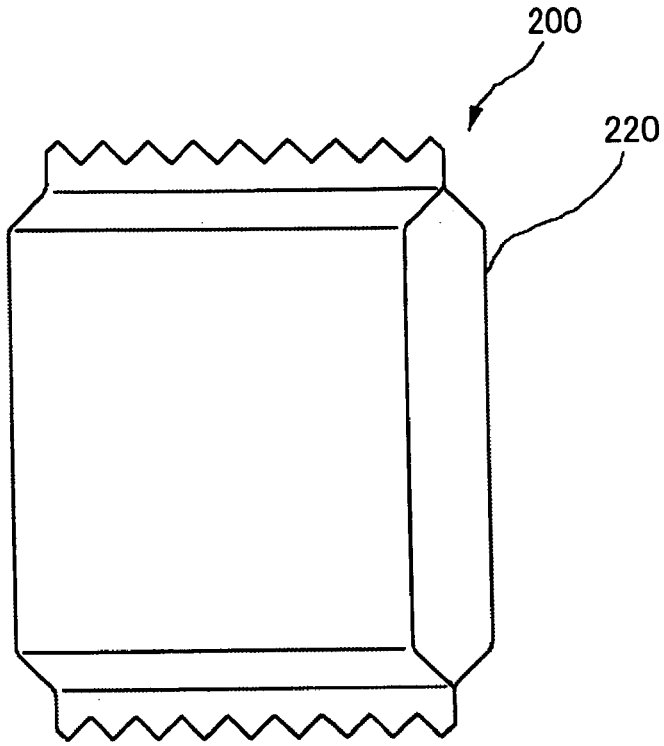
FIG. 9A is an external view showing a package before it is opened.
Figure 9B:
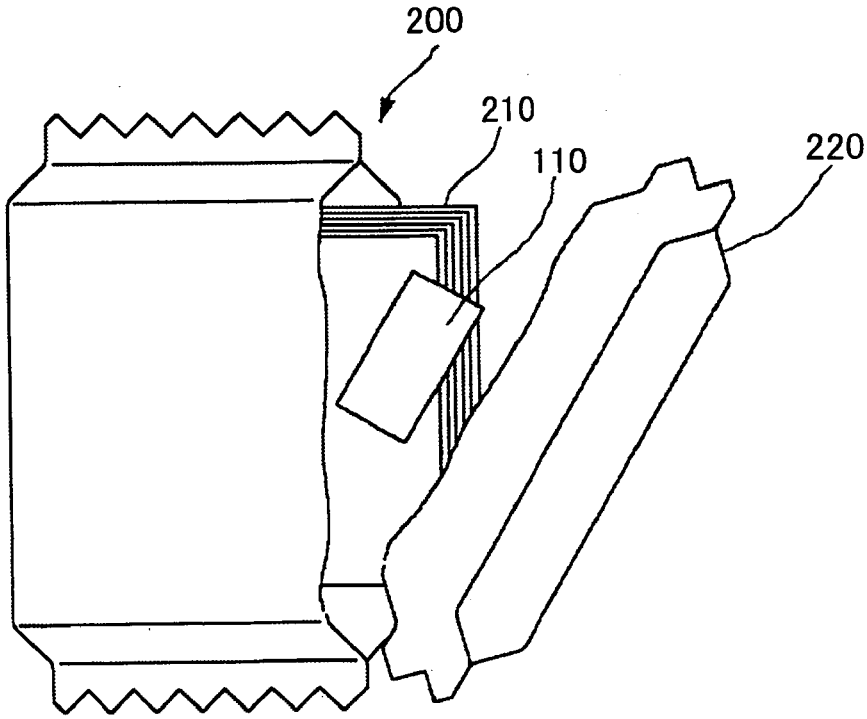
FIG. 9B is an external view showing a package when it has been opened.

FIG. 9A is an external view of a package before it is opened, and FIG. 9B shows an external view when the package has been opened.

The package 200 includes paper 210, a memory card 110, and packaging means 220. This package 200 is sold in stores separately from the printer body.

The paper 210 is, for example, plain paper, glossy paper, photo paper, or OHP sheets. According to the characteristics of the various types of paper, the size, the thickness, the color correction for printing, etc., vary.

The memory card 110 is a storage medium having, for example, a storage element. The structure of the memory card will be described later.

The memory card 110 stores information about the paper 210 that is enclosed (hereinbelow, referred to as paper information). The paper information includes, for example, information for identifying the paper (for example, an identifier such as a product number), and information about the kind of the paper (such as plain paper, glossy paper, and photo paper), the size of the paper, the thickness of the paper, and the color correction for printing. Further, the paper information also includes, for example, information about when the paper was manufactured. The paper information stored in the memory card 110 is read out wirelessly.

The packaging means 220 is for packaging the paper 210 and the memory card 110. The packaging means 220 may be, for example, a wrapping paper or a box. When the packaging means 220 is opened, the paper 210 and the memory card 110 can be taken out. Note that, the packaging means 220 may be opened, for example, by tearing using notches on the packaging means, or may be opened in other ways.

In this embodiment, after opening the packaging means 220, the pieces of paper 210 are inserted into the paper-supply insertion opening 11A. Then, the paper 210 is printed based on predetermined print conditions.

Further, in this embodiment, when the packaging means 220 is opened, the memory card 110 can be taken out of the packaging means 220 separately from the paper 210. By taking out the information of the memory card 110, the paper information can be obtained without examining the enclosed paper 210. The method for using this memory card will be described later.

Configuration of Memory Card

Next, referring to FIG. 10A and FIG. 10B, a configuration of the memory card 110 is described along with a configuration for transmitting and receiving data. FIG. 10A is a plan perspective view showing a configuration of the memory card 110. FIG. 10B is a block diagram for explaining the internal structures of the memory card 110 and the transmit-receive section 95.

The memory card 110 has an IC chip 111, a capacitor 112, an antenna 113, and a film 114. The configuration of the IC chip 111 will be described later. The capacitor 112 is a resonant capacitor formed by etching a metal film. The antenna 113 is structured by a flat coil. The film 114 is for covering the IC chip 111, the capacitor 112, and the antenna 113, and is structured by an insulating plastic film.

The IC chip 111 has a rectifier 1111, a signal analysis section RF (Radio Frequency) 1113, a control section 1115, and a memory cell 1117. The rectifier rectifies a high-frequency magnetic field that the antenna 113 has captured to make it into a direct-current power source for driving each circuit in the IC chip. The memory cell 1117 is a nonvolatile memory that is electrically readable/writable, such as a NAND flash ROM, and it is possible to store information that has been written in as well as read out the stored information from the outside. The memory cell 1117 stores information about the paper.

The transmit-receive section 95 has an antenna 96 and a transmit-receive circuit 97. The antenna 96 functions as communication means for carrying out communication with the memory card. The antenna 96 is covered by an insulating plastic film (not shown), as is the antenna 113 of the memory card. The transmit-receive circuit 97 generates high-frequency signals, induces a high-frequency magnetic field via the antenna 96, and communicates wirelessly with the memory card 110. The transmit-receive circuit 97 is connected to the control unit 60 and controlled by the control unit 60.

In this embodiment, communication between the antenna 96 provided on the printer body side and the memory card 110 is carried out wirelessly, and therefore, non-contact communication becomes possible. Therefore, as compared to a case of using contact-type connectors, the durability improves, and handling becomes easier.

Card Slot

Figure 11:
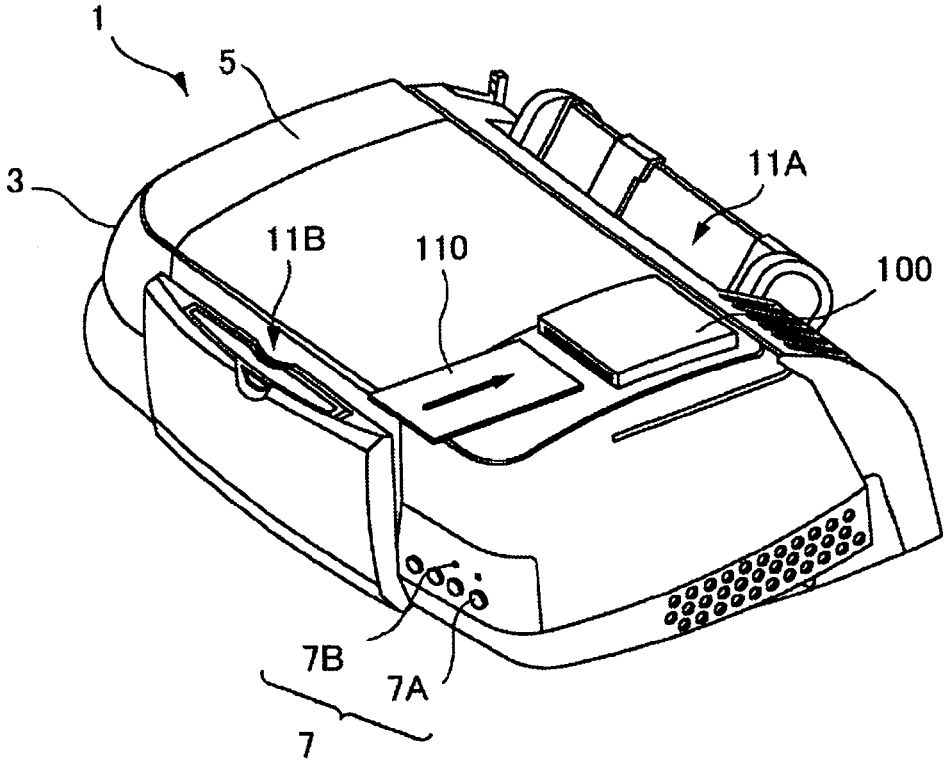
FIG. 11 is a schematic diagram of an external appearance of the printer of the present embodiment.
Figure 12:
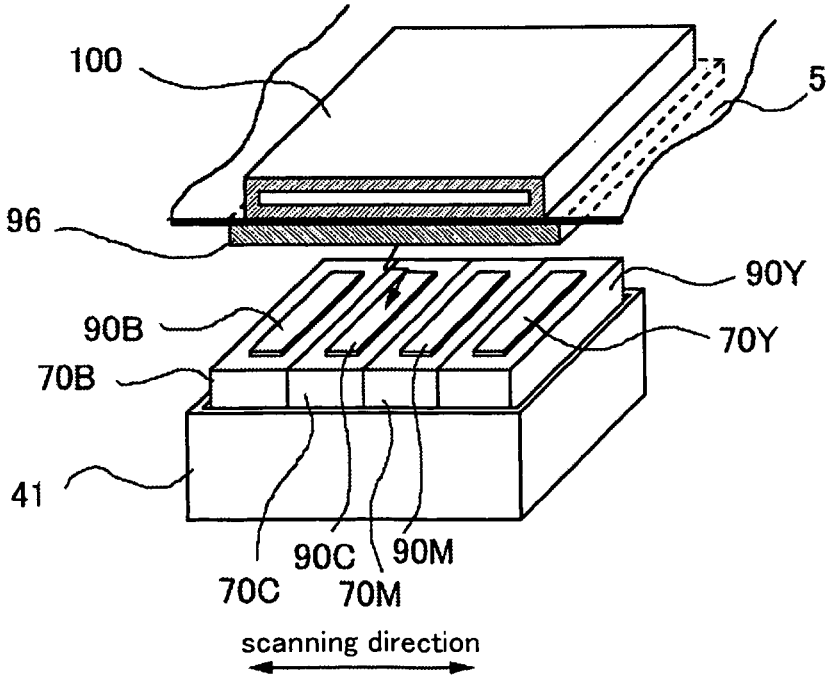
FIG. 12 is an explanatory diagram showing a positional relationship between a slot and an antenna of the printer of the present embodiment.

FIG. 11 is a schematic diagram of an external appearance of the printer of this embodiment. In this figure, the structural components which have already been explained accompany the same reference characters, and therefore, explanation is omitted.

Aside from the above-described structural components, the printer 1 has a housing 3, a top lid 5, an operating section 7, and a slot 100. The housing is a box for accommodating the above described structural components (for example, the paper carrying unit 10, the ink ejection unit 20, the cleaning unit 30, the carriage unit 40, the measuring instrument group 50, and the control unit 60). The top lid 5 is a lid which is rotatable, in an opening and closing direction, about a rotation shaft (not shown) provided on the housing 3. When the top lid 5 is opened, for example, the paper carrying unit 10 and the carriage unit 40 accommodated inside the housing 3 are visible. The top lid 5 is opened and closed, for example, when the cartridge 70 is exchanged. The operating section 7 is provided on the housing 3, and comprises buttons 7A and lamps 7B. The user can set the print conditions (such as print mode) of the printer 1 by operating the buttons 7A. Further, with the flashing of the lamp 7B, the operation of the printer 1 may be confirmed.

The slot 100 configures an attach/detach section to and from which a memory card 110, which is an external storage medium, can be attached and detached. The slot 100 has a card insertion opening with a hollow section, and is provided on the top lid 5. When the memory card 110 is inserted into the slot 100, the memory card 110 is positioned by the inner walls of the slot 100. Note that, when the memory 110 is inserted in the slot 100, the lamp 7B may flash, or the color of the lamp 7B may change. Further, when the memory 110 inserted in the slot 100 is not correctly inserted, this can be notified to the user through a change in the lamp 7B.

FIG. 10 is an explanatory diagram showing the positional relationship between the slot 100 and the antenna 96 of the printer of the present embodiment. In the figure, the structural components which have already been explained accompany the same reference characters, and therefore, explanation is omitted.

The antenna 96 is a flat antenna, and one side of the antenna faces the storage unit 90, and the other side faces the memory card 110 inserted in the slot 100. According to this embodiment, by using the characteristic in which the flat antenna generates a magnetic field on both sides thereof, wireless communication is possible with both the memory card in the slot and the storage unit of the carriage. That is, according to this embodiment, the same antenna can be used as the antenna for carrying out wireless communication with the memory card inserted in the slot and as the antenna for carrying out wireless communication with the storage unit provided on the cartridge. In this way, it is possible to provide an inexpensive and space-saving printer.

Further, the antenna 96 is provided on an inner side of the top lid 5. That is, when the top lid 5 is in a closed state, the antenna 96 can face the storage unit 90 provided on the upper surface of the cartridge 70 in the printer. Since the antenna 96 of this embodiment is provided on the top lid 5, the cartridge 70 can be exchanged easily because the storage unit 90 of the cartridge and the antenna 96 are not in a state in which they face each other when the cartridge is being exchanged.

As explained with respect to FIG. 11, the slot 100 is provided on the top lid 5. The position where the antenna 96 is provided on the top lid 5 is on the opposite side from where the slot 100 is provided. Since the antenna 96 is provided on the backside of the slot 100, the memory card 110 is installed close to the antenna 96, thereby improving reliability of wireless communication with the memory card.

When the memory card 110 is inserted into the slot 100, the memory card 110 is placed parallel with the antenna 96 (not shown in FIG. 11). Since the storage element with a similar structure as the storage unit 90 is provided on the memory card 110, the antenna of the memory card 110, which is inserted in the slot 100, and the antenna 96 become parallel, and therefore, wireless communication is brought into a satisfactory state.

Note that, if the antenna 96 is provided above the above-mentioned cleaning unit 30, the cleaning unit 30 will be positioned below the carriage 41 in FIG. 14, so that during the operation of preventing clogging in the nozzles of the head, the antenna 96 will be able to communicate with the storage unit 90.

Further, if the antenna 96 is provided above the printing region, the medium to be printed will be placed below the carriage 41 in FIG. 14, so that during the printing operation, the antenna 96 will be able to communicate with the storage unit 90. Thus, in such a case, the antenna 96 will be able to write, into the storage unit 90, information about the amount of ink (used amount or remaining amount) in real time during the printing operation.

As regards the antenna 96, the signals thereof pass through the top lid 5, and the antenna wirelessly communicates with the storage element of the memory card 110 inserted in the slot 100. Therefore, the material of the top lid 5 is preferably a nonmagnetic material, and is preferably plastic. By using such materials for the top lid 5, reliability of communication with the memory card 110 can be improved.

Similarly, the material of the slot 100 is preferably a nonmagnetic material, and is preferably plastic. By using such materials for the slot 100, reliability of communication with the memory card 110 can be improved.

Communicating Operation

Figure 13:
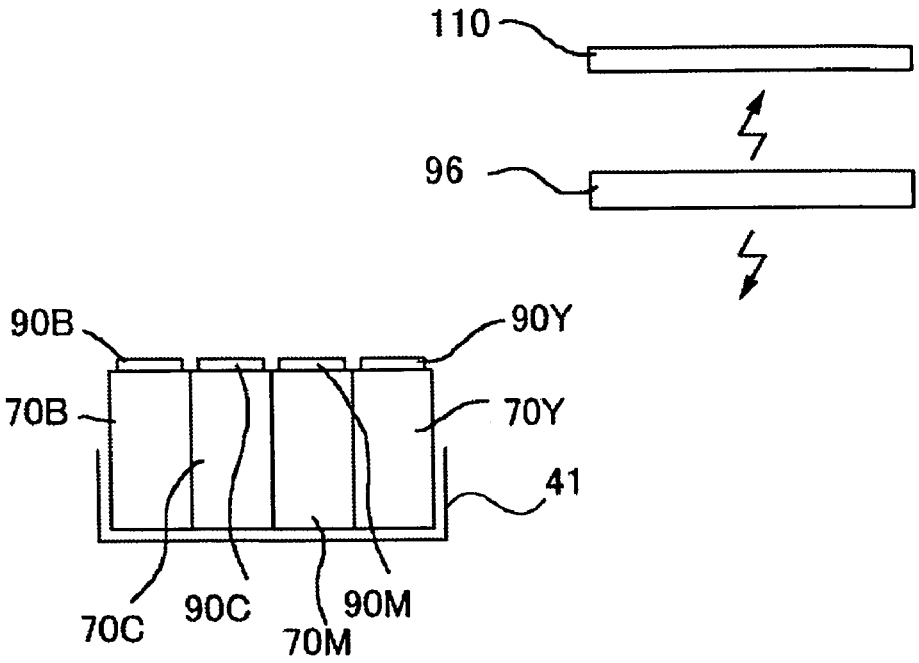
FIG. 13 is an explanatory diagram of a communicating operation in the present embodiment, and is an explanatory diagram showing a state in which the antenna cannot communicate with the storage unit.
Figure 14:
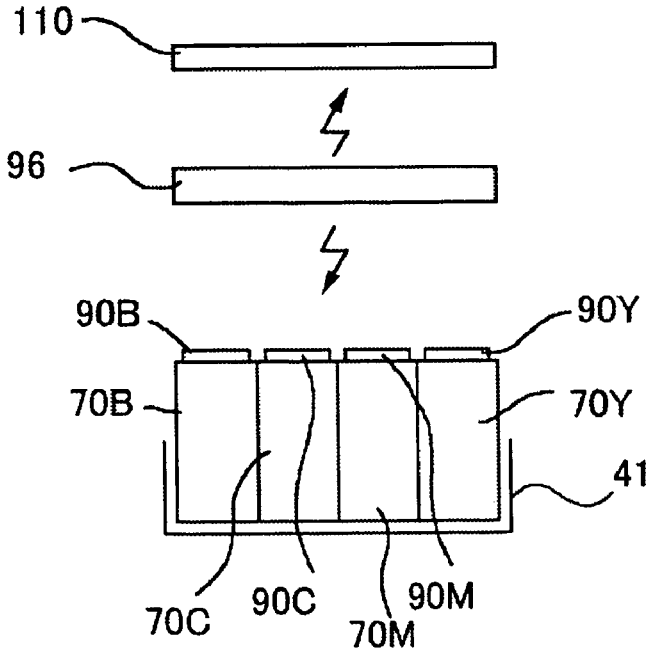
FIG. 14 is an explanatory diagram of a communicating operation in the present embodiment, and is an explanatory diagram showing a state in which the antenna can communicate with the storage unit.

Using FIG. 13 and FIG. 14, the communicating operation is explained. Note that, FIG. 13 is an explanatory diagram showing a state in which the antenna 96 cannot communicate with the storage unit 90. Further, FIG. 14 is an explanatory diagram showing a state in which the antenna 96 can communicate with the storage unit 90. Note that, in these figures, the structural components which have already been explained accompany the same reference characters, and therefore, explanation is omitted.

In FIG. 13, the carriage 41 is positioned so that the storage unit 90 is in a position distant from the antenna 96. In this state, even if the antenna 96 generates a magnetic field to communicate wirelessly, the antenna 96 can only communicate with the memory card 110, and cannot communicate with the storage unit 90 of the cartridge 70.

On the other hand, in FIG. 14, the carriage 41 is positioned so that the storage unit 90 faces the lower side of the antenna 96. That is, in this state, the antenna 96 is positioned between the storage unit 90 and the slot 100 (that is, the memory card 110). In this state, when the antenna 96 generates a magnetic field to communicate wirelessly, it is possible to communicate both with the storage unit 90 and the memory card 110 at the same time.

In the state of FIG. 14, when the antenna 96 tries to communicate with the storage unit 90, a magnetic field is generated also on the memory card 110 side, and therefore, signal collision becomes a problem. Therefore, when communication is to be carried out in this state, an identifier (for example, ID information) is included in the signal to be communicated to thereby avoid signal collision. Note that, by including identifiers in the signals to be communicated, even if the antenna 96 is in a state in which it is able to communicate with a plurality of storage units 90, the antenna can communicate with an arbitrary storage unit 90.

The antenna of this embodiment can face a plurality of storage units 90. Therefore, the antenna 96 can be large, and the signals to be transmitted and received can be made large, thereby improving communication reliability. Further, since a single antenna can face a plurality of storage units 90, the number of antennas can be reduced, and therefore, manufacturing costs can be reduced.

Method for Using Memory Card

Figure 15:
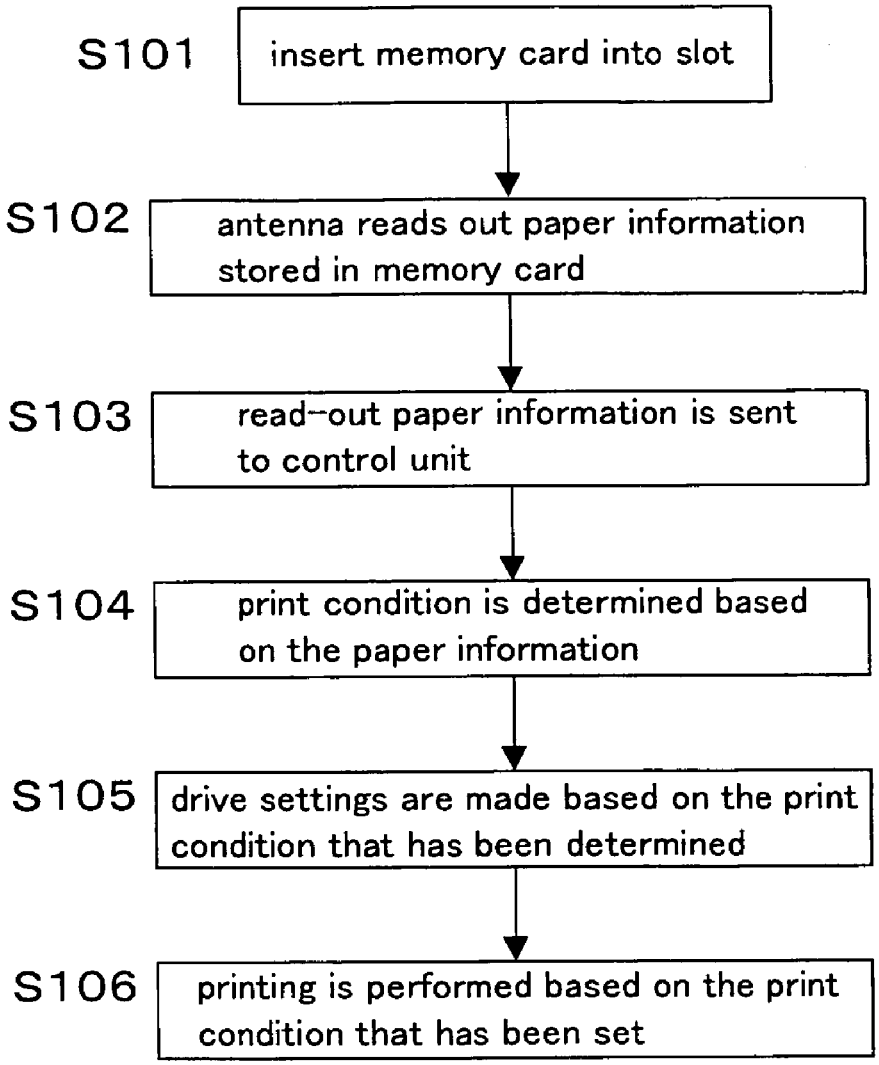
FIG. 15 is a flowchart for explaining an example of a method for using the memory card of the present embodiment.

FIG. 15 is a flowchart for explaining an example of a method for using a memory card 110.

First, the user inserts a memory card 110, which has been taken out from the packaging means of the package, into the slot 100 (S101). Note that, this memory card 110 is packaged together with the paper that the user has purchased, and is taken out from the packaging means 220 of the package 200. The memory card 110 stores information about the paper which is packaged together (hereinbelow, referred to as paper information). The paper information includes, for example, information for identifying the paper (for example, an identifier such as a product number) and information about the kind of the paper (such as plain paper, glossy paper, and photo paper), the size of the paper, the thickness of the paper, or the color correction for printing, or about when the paper was manufactured. Note that, the paper taken out from the packaging means of the package is inserted into the insertion opening 11A of the printer.

Next, the antenna 96 reads out paper information stored in the memory card 110 (S102). The timing that the antenna 96 reads out the paper information may be when the printer 1 detects that the memory card 110 has been inserted into the slot 100, or the antenna may periodically carry out communication with the memory card 110.

When the antenna 96 reads out the paper information, the paper information is sent to the control unit 60 (S103). Then, the paper information is stored in the memory 65 in the control unit 60.

Next, the control unit 60 determines the print conditions based on the paper information (S104). For example, based the on information about the kind of the paper (such as plain paper, glossy paper, and photo paper), conditions such as the ink ejection amount for each color is determined. Further, based on the information about the size of the paper, control conditions of the CR motor 42 relating to the movement of the carriage 41, the control conditions of the PF motor 15, and the like are determined. Further, based on the information about the thickness of the paper, the timing for ejecting ink, the control conditions of the PF motor 15, and the like are determined. Further, based on the information about color correction for printing, conditions such as ink ejection amount for each color and the like are determined. Further, based on when the paper was manufactured, conditions such as ink ejection amount for each color and the like are determined, in consideration of the deterioration of paper.

Next, the control unit 60 sets up the driver based on the print conditions that have been determined (S105). For example, the head driver 22 is set based on the conditions of ink ejection amount for each color. Further, the CR motor driver 43 is set based on the control conditions of the CR motor 42. Further, the PF motor driver 16 is set based on the control condition of the PF motor 15. Further, the head driver 22 is set based on the timing for ejecting ink. Note that, the setting of the drivers does not have to be carried out based on the print conditions that have been determined, but may be carried out based on the paper information (namely, S104 may be omitted).

The control unit 60 carries out printing based on the drivers that have been set as above (S106). Note that, the paper which is printed is the paper that was packaged together with the memory card 110, which has been inserted into the slot 100. Since printing is carried out with a printer that has been appropriately set for this paper, high-precision printing can be performed.

In this embodiment, the user only needs to insert the memory card 110, which is packaged together with the paper to be printed, into the slot 100 to set the drivers of the printer. Thus, according to this embodiment, the user does not have to manually carry out complicated settings of the drivers, and it is possible to make the operation of the printer easy.

Further, in this embodiment, the settings of the printer itself are made just by inserting the memory card into the slot, and therefore, the settings of the printer drivers in the computer unit, to which the printer is connected, do not have to be changed.

Configuration of Printing System Etc.

Next, an embodiment of a printing system (computer system), a computer program, and a storage medium storing a computer program, which is an example of an embodiment according to the present invention, is explained with reference to the drawings.

Figure 16:
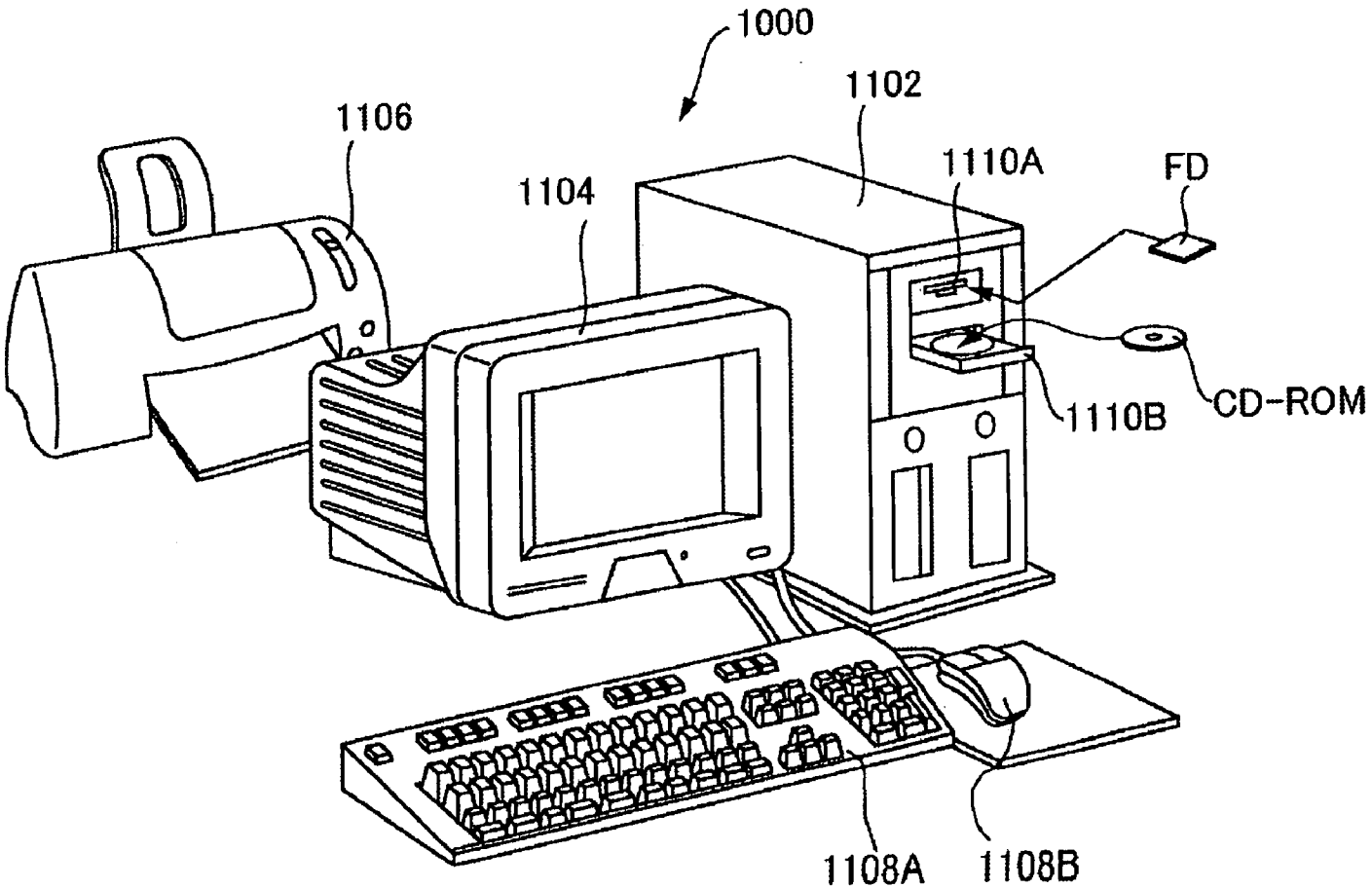
FIG. 16 is an explanatory diagram showing an external configuration of a computer system.

FIG. 16 is an explanatory diagram showing the external structure of the computer system. A computer system 1000 is provided with a main computer unit 1102, a display device 1104, a printer 1106, an input device 1108, and a reading device 1110. In this embodiment, the main computer unit 1102 is accommodated within a mini-tower type housing; however, this is not a limitation. A CRT (cathode ray tube), a plasma display, or a liquid crystal display device, for example, is generally used as the display device 1104, but this is not a limitation. The printer 1106 is the printer described above. In this embodiment, a keyboard 1108A and a mouse 1108B are used as the input device 1108; however, it is not limited to these. In this embodiment, a flexible disk drive device 1110A and a CD-ROM drive device 110B are used as the reading device 1110, but it is not limited to these, and it may also be a MO (magnet optical) disk drive device or a DVD (digital versatile disk), for example.

Figure 17:
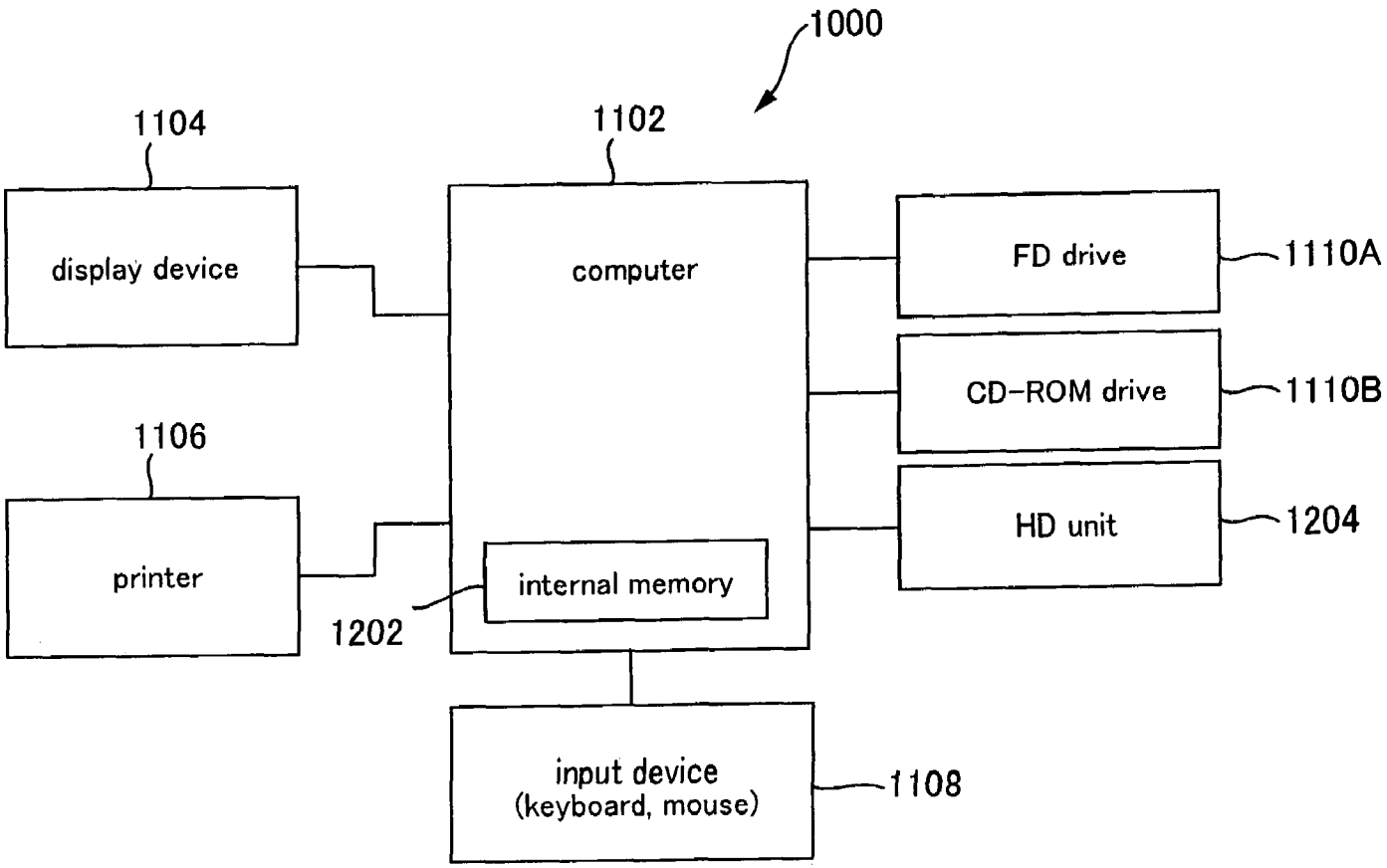
FIG. 17 is a block diagram showing a configuration of the computer system.

FIG. 17 is a block diagram showing the configuration of the computer system shown in FIG. 16. An internal memory 1202 such as a RAM within the housing accommodating the main computer unit 1102 and, also, an external memory such as a hard disk drive unit 1204 are provided.

Note that, in the above description, an example was described in which the computer system is constituted by connecting the printer 1106 to the main computer unit 1102, the display device 1104, the input device 1108, and the reading device 1110; however, this is not a limitation. For example, the computer system can be made of the main computer unit 1102 and the printer 1106, or the computer system does not have to be provided with any one of the display device 1104, the input device 1108, and the reading device 1110. It is also possible for the printer 1106 to have some of the functions or mechanisms of the main computer unit 1102, the display device 1104, the input device 1108, and the reading device 1110. As an example, the printer 1106 may be so configured to include an image processing section for carrying out image processing, a display section for carrying out various types of displays, and a recording media attachment/detachment section to and from which recording media storing image data captured by a digital camera or the like are attached and detached.

In the embodiment described above, it is also possible for the computer program for controlling the printer to be incorporated in the memory 65 of the control unit 60. The operations of the printer in the embodiment described above may then be achieved by the control unit 60 executing this computer program.

As a whole system, the computer system that is thus achieved becomes superior to conventional systems.

Modified Example of First Embodiment

In the foregoing, a printer, for example, according to the present invention was described based on the first embodiment. However, the foregoing embodiment is for the purpose of elucidating the present invention and is not to be interpreted as limiting the present invention. The invention can of course be altered and improved without departing from the gist thereof and includes equivalents thereof. In particular, the printing apparatus according to the invention includes the embodiments mentioned below as well.

<About the Package>

According to the above-described embodiment, there were only paper and a memory card inside the packaging means. However, the contents of the packaging means is not limited to the above. For example, other structural components may be included in the packaging means.

<About the Structure of Slot 1>

According to the above-described embodiment, the slot into which the memory card can be inserted is provided on the top lid. However, the structure for attaching or detaching the memory card is not limited to the slot.

Figure 18:
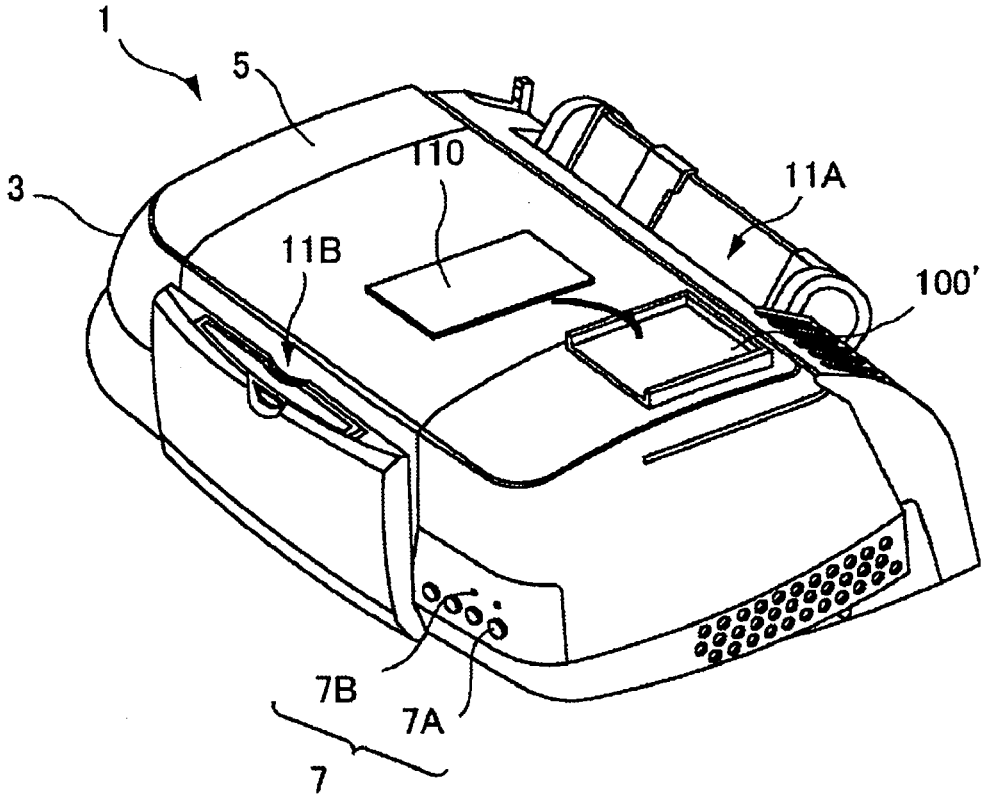
FIG. 18 is a schematic diagram of an external appearance of a printer according to another embodiment.

FIG. 18 is a schematic diagram of an external appearance of a printer of another embodiment. In this diagram, the same reference characters are assigned to the structural components that are the same as those in the above-described embodiment, and therefore, explanation is omitted. The printer of this embodiment has a restriction means 100' as an attach/detach section for the memory card 110 in place of the slot of the above-described embodiment.

The restriction means 100' has a projection. This projection restricts the position of the edges of the memory card 110, thereby restricting the installing position of the memory card 110. In this way, the stabilization and the repeatability of the position of the memory card 110 are improved so that the position of the memory card 110 does not change each time the memory card 110 is attached/detached. As a result, when the memory card is installed on the printer 1, the memory card 110 can be positioned on the back side of the antenna (not shown), and the antenna can communicate wirelessly with the memory card 110.

That is, the attach/detach section for the memory card may be other means as long as it has the function, as with the slot 100 or the restriction means 100', of positioning the memory card in such a position that the antenna can communicate wirelessly with the memory card 110. Further, it is preferable that the attach/detach section for the memory card has a function of positioning the memory card 110 on the back side of the antenna 96.

<About the Structure of Slot 2>

According to the above-described embodiment, the slot into which the memory card can be inserted is a hollow section that only has a card insertion opening. However, the structure of the slot is not limited thereto.

For example, the slot may also be used as a slot for inserting a recording media that stores image data captured by a digital camera or the like. That is, it is only necessary that the antenna 96 is able to communicate wirelessly with the memory card 110 when the memory card 110 is inserted in the slot (the above-mentioned recording media attachment/detachment section) which is used for inserting other recording media.

In this case, the antenna 96 would be provided on the back side of the slot (recording media attachment/detachment section) used for inserting other recording media.

<About the Setup of Driver 1>

According to the above-described embodiment, the printer was set up based on the paper information read from the memory card. However, this is not a limitation.

For example, the paper information that has been read from the memory card by the antenna may be sent to the computer unit that is connected to the printer, and the printer driver of the computer unit may be set up.

Figure 19:
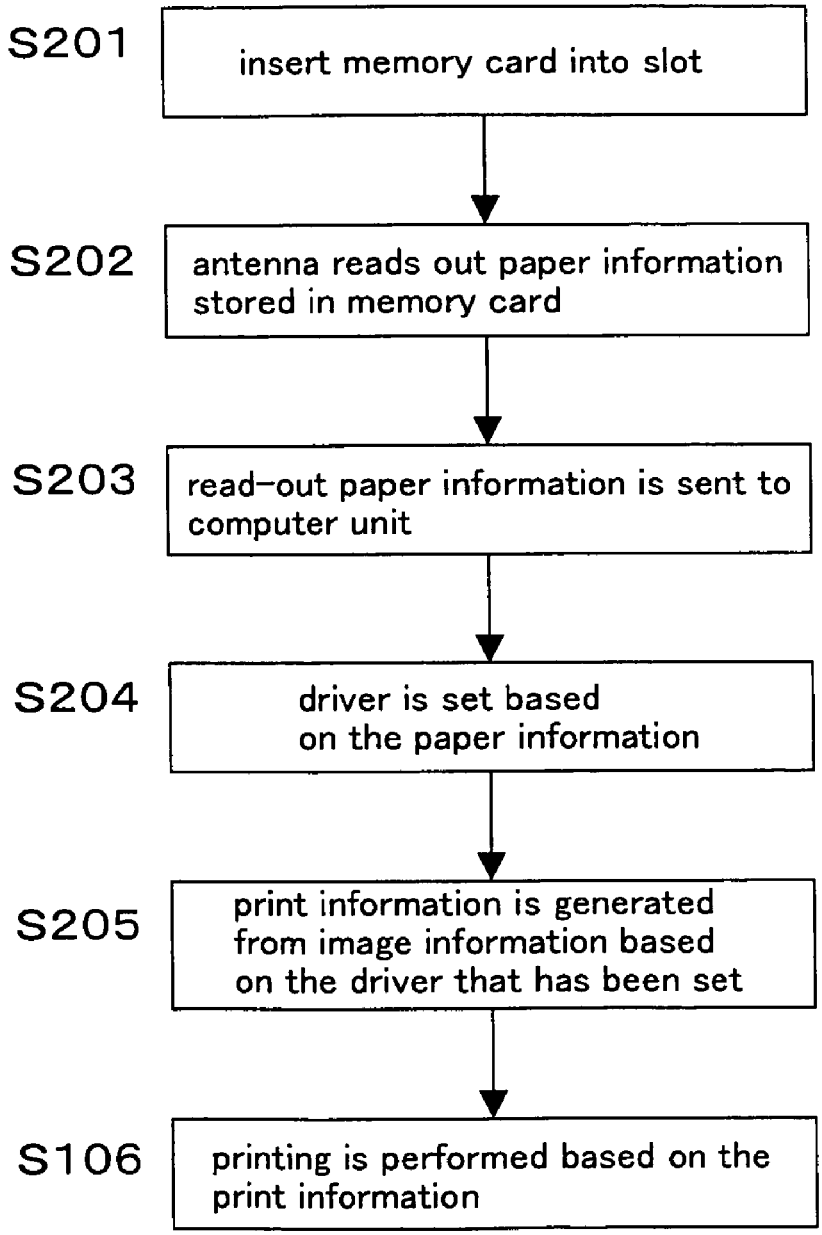
FIG. 19 is a flowchart for when a driver of a computer unit is set.

FIG. 19 is a flowchart for when the printer driver of the computer unit is set up.

First, the user inserts the memory card 110 into the slot 100 (S201). Note that, this memory card 110 is the one that was taken out from the packaging means 220 of the package 200 bought by the user. The memory card 110 stores paper information about the paper that is enclosed with the card. The paper information includes, for example, information for identifying the paper (for example, an identifier such as a product number), and information about the kind of paper (such as plain paper, glossy paper, and photo paper), the size of the paper, the thickness of the paper, the color correction for printing, and about when the paper was manufactured.

Next, the antenna 96 reads out the paper information stored in the memory card 110 (S202). The timing that the antenna 96 reads out the paper information may be when the printer 1 detects that the memory card 110 has been inserted into the slot 100, or the antenna may periodically carry out communication with the memory card 110.

When the antenna 96 reads out the paper information, the paper information is sent to the main computer unit 1102 (S203). Then, the paper information is stored in a memory 2202 of the main computer unit 1102. Note that, the main computer unit 1102 may display the received paper information on the display device 1104.

Next, the main computer unit 1102 sets up the printer driver based on the paper information (S204). Note that, if the main computer unit 1102 stores information for a plurality of printer drivers, then the computer unit may select an appropriate printer driver from the plurality of printer drivers based on the paper information. Further, the setup results of the printer driver may be displayed on the display device 1104.

Next, the computer unit generates print information from the image information based on the printer driver that has been set up (S205). Then, the generated print information is sent to the printer.

Then, the control unit 60 carries out printing based on the print information (S206). Note that, the paper which is printed is the paper that was packaged together with the memory card 110, which has been inserted into the slot 100.

Since printing is carried out with a printer that has been appropriately set for this paper, high-precision printing can be performed.

In this embodiment, the user only needs to insert the memory card 110, which is packaged together with the paper to be printed, into the slot 100 to set up the printer driver. Thus, also in this embodiment, the user does not have to manually carry out complicated settings of the driver, and it is possible to make the operation of the printer easy.

<About the Memory Card 1>

According to the above-described embodiment, the memory card is packaged together with the paper and stores information about the paper. However, the method for using the memory card is not limited thereto.

For example, information about the operation of the printer 1 (for example, control history) may be written into the memory card 110. Then, if the printer 1 breaks down, the user may bring the memory card 110, which stores the information about the operation of the printer, to a service center, thereby prompt repair can be expected.

Further, other information may be written into the memory card, or read out from the memory card, by the antenna.

<About the Memory Card 2>

According to the above-described embodiment, communication with the memory card is carries out wirelessly. However, communication with the memory card is not limited thereto.

For example, communication with the memory card may be through contact. In this case, the printer has a connector as a communication means for connecting to the memory card, and the memory card has a contact point which is to be connected with the connector.

Further, it is preferable that the memory card has a mark for indicating the direction of the memory card. Note that, this mark is for enabling identification, through sight or through touch, of the direction of the memory card, such as a letter, a symbol, or a cut-out section. In this way, the memory card can be inserted in the correct direction, and therefore, the memory card is connected correctly to the connector.

<About the Memory Card 3>

According to the above-described embodiment, the memory card stores paper information such as the kind of paper or the size of the paper. However, the paper information which the memory card stores is not limited thereto.

For example, the paper information may be information about the print-condition of the paper. If the memory card stores information about the print condition in this way, then based on this information, the printer itself or the printer driver of the computer unit can be directly set up. Note that, in this case, it is preferable that which type of printer is to perform printing on the paper inside the package is specified, because the print condition supports a specific type of printer.

<About the Memory Card 4>

Further, the paper information that the memory card stores can be other information. For example, the paper information may be information about where the latest driver information for the paper can be downloaded.

In this case, after the computer unit receives such paper information (information about where the driver information can be downloaded) from the printer, the latest driver information is downloaded from a predetermined location on the Internet, and the printer driver is set up based on the downloaded driver information. In this way, the user can easily carry out settings for printing based on the latest information.

<About the Size of Antenna>

According to the above-described embodiment, one antenna was large enough to face a plurality of cartridges. However, the size of the antenna is not limited thereto.

For example, the antenna can be of a size that faces one cartridge. Then, when the antenna communicates with storage units of other cartridges, the carriage can be moved in the scanning direction.

According to this embodiment, since the antenna can be made smaller, the manufacturing cost can be reduced. Further, since the antenna can be made smaller, it is possible to achieve space saving of the printer.

<About the Cartridge>

According to the above-described embodiment, an ink cartridge is provided for each color. However, the structure of the cartridges is not limited thereto. For example, the cartridges for each of the colors (70C, 70M, 70Y) may be combined together into one color cartridge.

<About the Arrangement of Storage Unit>

According to the above-described embodiment, the storage unit 90 is provided on a top surface of the cartridge 70. However, the arrangement of the storage unit 90 is not limited thereto. For example, the storage unit 90 may be provided on a side surface of the cartridge 70. In this case, the antenna may be provided in a position where it can face the side surface of the cartridge 70, and a slot may be provided on the back side of the antenna.

Even with this arrangement, effects similar to those of the above-described embodiment can be achieved.

<About the Nozzles>

In the embodiment described above, the nozzles are provided in the head 21, and the head 21 is provided on the carriage 41, and thus the nozzles are provided integrally with the carriage 41. However, the configuration of the nozzles and the head 21 is not limited thereto. For example, the nozzles or the head may be provided integrally with the cartridge and be attachable and detachable to and from the carriage 41.

In other words, the above explanation was made using a cartridge as an example of an "ink container", but an "ink container" need only be a container that is capable of containing ink, and whether it is provided with nozzles or not should not influence the interpretation of this term.

2. Second Embodiment

Next, the second embodiment will be explained. "Overview of Printing Apparatus", "Configuration of Storage Unit", "Contents of Package", "configuration of Memory Card", "Card Slot", "Method for Using Memory Card", and "Configuration of Printing System Etc.", for example, of the present embodiment are substantially the same as those of the above-described embodiment, and therefore, explanation will be omitted.

Configuration of Cartridge and Attach/Detach Section (Frame)

Figure 21:
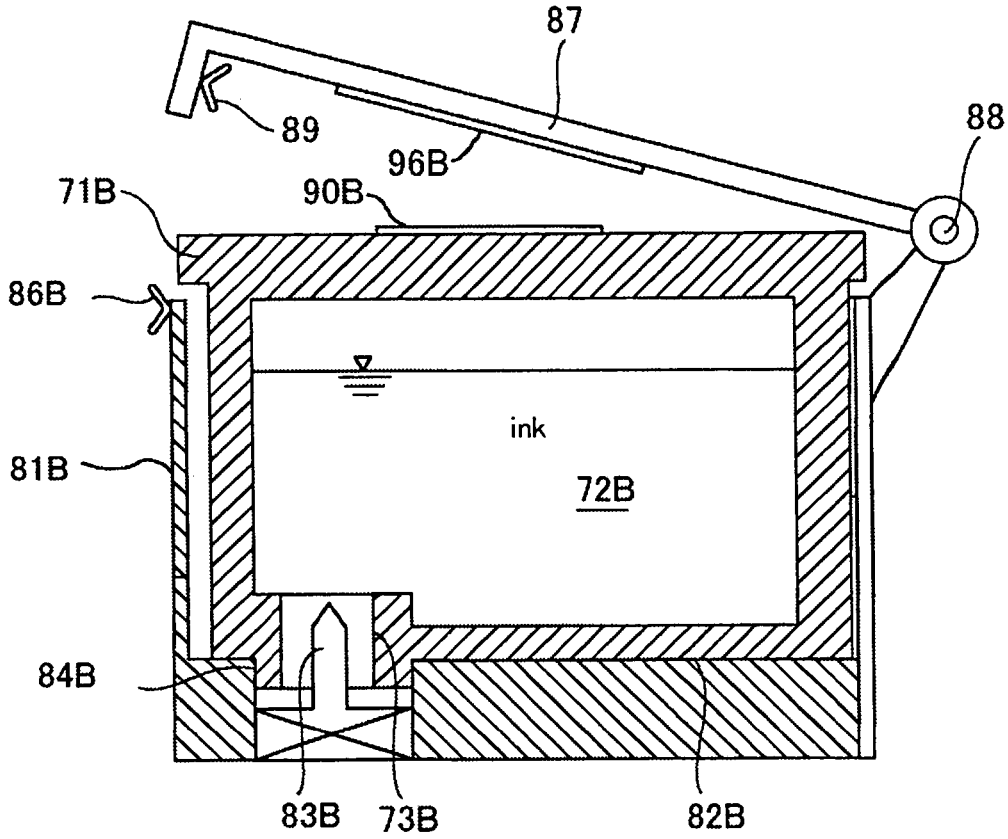
FIG. 21 is a sectional diagram showing an internal structure of the cartridge, an internal structure of the attach/detach section, and a state in which the cartridge is mounted on the attach/detach section.

The basic structure of the above-described cartridges 70 for each of the colors are the same. Referring to FIG. 20 and FIG. 21, the structure of the black ink cartridge 70B and the structure of the attach/detach section 80B on which the cartridge 70B is mounted are explained.

FIG. 20A is a schematic diagram showing a structure of the black ink cartridge 70B. FIG. 20B is a schematic diagram of an attach/detach section 80B to and from which the cartridge 70B can be attached and detached. Further, FIG. 21 is a sectional diagram showing an internal structure of the cartridge 70B, an internal structure of the attach/detach section 80B provided on the carriage, and a state in which the cartridge 70B is mounted on the attach/detach section 80B.

In FIG. 20A and FIG. 21, the cartridge 70B has a body 71B and a storage unit 90B. The body 71B comprises an ink containing section 72B, which contains black ink inside, and an ink supply opening 73B, and is formed of synthetic resin. The storage unit 90B is provided on an upper surface of the cartridge 70B. The reason why the storage unit 90B is provided on the upper surface of the cartridge 70B will become clear later on. Further, the structure of the storage unit 90B will be described later.

In FIG. 20B and FIG. 21, the attach/detach section 80B has a retaining section 81B, a bottom section 82B, a needle 83B, a recessed section 84B, guides 85B, and a fixing tool 86. The retaining section 81B is a section for retaining the cartridge 70B from the sides, and forms a space for mounting the cartridge 70B. The bottom section 82B is a section for supporting the cartridge 70B from below. The needle 83B is to be pierced into the ink supply opening 73B of the cartridge 70B, and ink can be supplied by piercing the needle 83B into the ink supply opening 73B. The recessed section 84B is for receiving the ink supply opening 73B of the cartridge 70B. The guides 85B are for guiding the ink supply opening 73B of the cartridge 70B into the recessed section, and are provided on inner walls of the recessed section 84B.

In FIG. 21, the carriage 41 has the attach/detach section 80B, as well as a lid 87, a rotation shaft 88, a clamping tool 89, and an antenna 96B. The lid 87 is provided on the carriage 41 via the rotation shaft 88, and can move rotatingly about the rotation shaft. When the lid 87 is tilted in the direction covering the cartridge 70B, the clamping tool 89 couples with the fixing tool 86, and the cartridge 70B is fixed to the attach/detach section 80B. Note that, the retaining section 81B, the bottom section 82B, and the lid 87 structure a frame which forms a space for mounting the cartridge 70B. Further, when the lid 87 is tilted in the direction covering the cartridge 70B, the cartridge 70B is pressed downward by the lid 87, and the needle 83B pierces into the ink supply opening 73B. Note that, the antenna 96B is arranged on the inner side of the lid 87 (namely, the inner side of the frame of the carriage 41), and is arranged so as to face the storage unit 90B. The antenna 96B will be described later on.

The cartridges 70 for the other colors and the attach/detach sections 80 for these cartridges 70 have substantially the same structure as the above described black ink cartridge 70B and the attach/detach section 80B, and therefore, explanation will be omitted. Note that the fixing tool 86, the lid 87, the rotation shaft 88, and the clamping tool 89 may be provided on each of the cartridges for each color, or may be shared among the cartridges for each color.

In this embodiment, since the antenna 96 is provided on the moving carriage 41, information can be written in or read out from the storage unit 90, even when the carriage 41 is moving. As a result, for example, while the carriage is being moved and the medium to be printed (such as paper) is being printed, the control unit 60 can write, into the storage unit 90, information about the used amount or the remaining amount of ink, in real time. Thus, even if the power of the printer unit is suddenly turned off and the cartridge 70 is exchanged, correct information about the cartridge 70 is written in the storage unit 90 of the cartridge 70.

Further, in this embodiment, as described above, the antenna 93 of the storage unit 90 is provided on the upper surface of the cartridge 70, and the antenna 96 of the transmit-receive section 95 is provided on the lid 87 of the carriage 41. When the lid 87 is closed so as to cover the cartridge 70 in order to fix the cartridge 70 on the carriage, the film 94 of the antenna 93 and a film (not shown) of the antenna 96 contact each other, and the antenna 96 presses, via the film, the storage unit 90. As a result, the distance between the antenna 93 and the antenna 96 becomes small, thus establishing a state in which communication is possible even with a weak radio wave. In other words, with such a structure, a power-conserving printer can be provided.

Arrangement of Antenna

Figure 22:
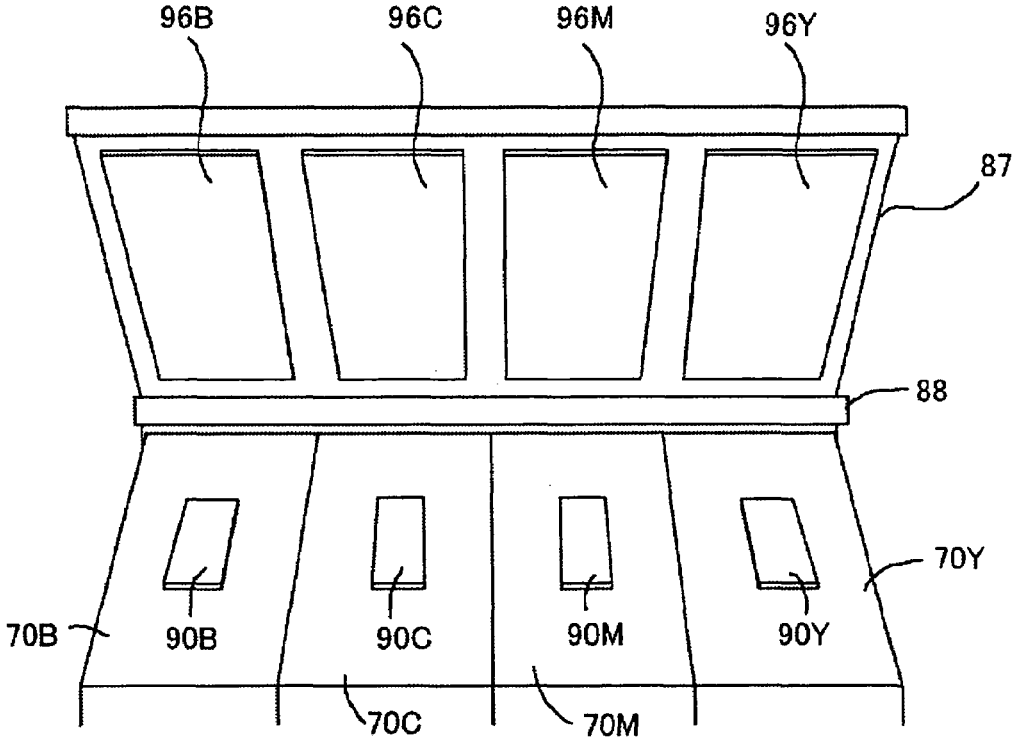
FIG. 22 is an explanatory diagram of a positional relationship between the antennas and the storage units.
Figure 23:
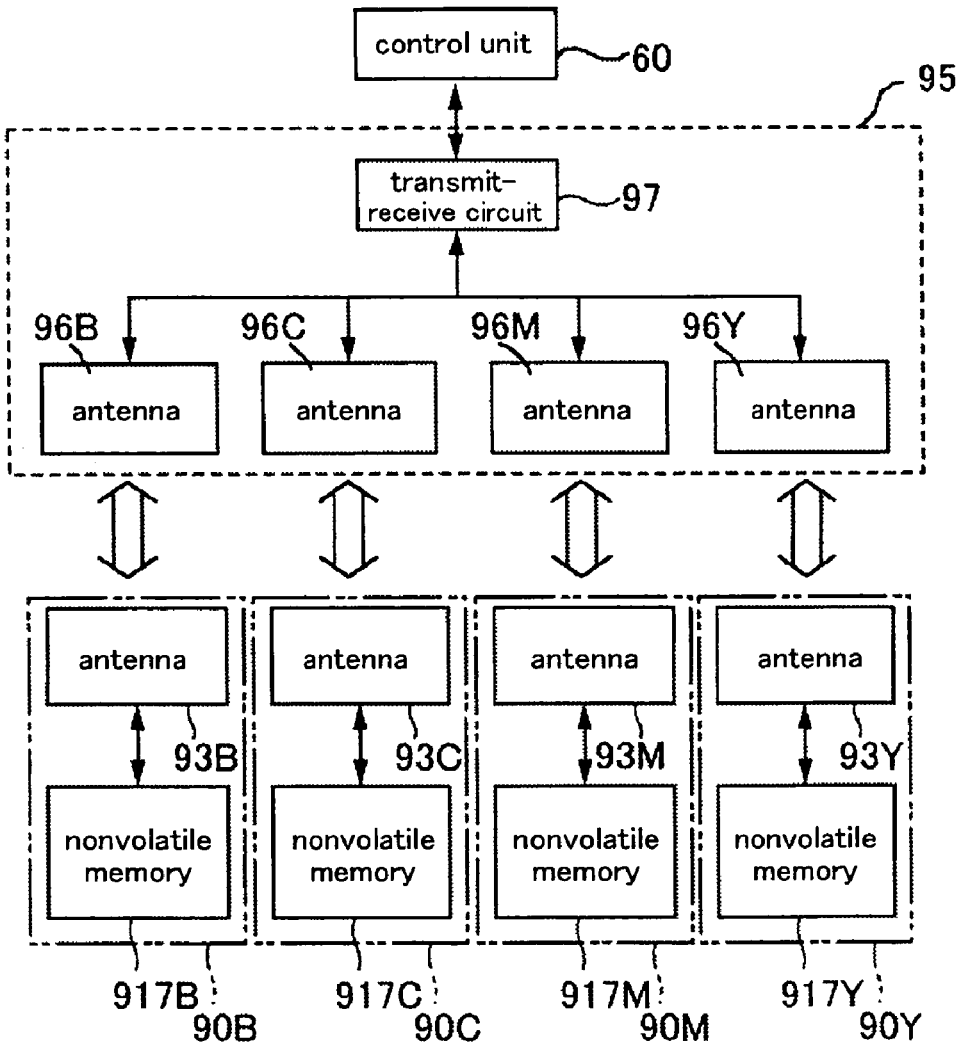
FIG. 23 is an explanatory diagram of a transmit-receive section in the case of FIG. 22.

FIG. 22 is an explanatory diagram of a positional relation ship between the antenna 96 and the storage unit 90. FIG. 23 is an explanatory diagram of a transmit-receive section when the antenna is arranged as in FIG. 22. In these figures, the same reference characters are assigned to the same structural components, and therefore, explanation is omitted.

In this embodiment, a plurality of antennas 96 are provided on the inner side of the lid of the carriage 41. Each of these antennas 96B, 96C, 96M, and 96Y is provided so as to respectively face the storage units 90B, 90C, 90M, and 90Y provided on each of the cartridges for each color.

In this embodiment, since a plurality of antennas 96 are provided on the inner side of the lid 87 of the carriage 41, the size of each antenna becomes small, and therefore, the signals to be transmitted and received become weak. However, as described above, since the distance between the antenna 93 and the antenna 96 is small, the unique effect that communication becomes possible can be achieved.

Note that, as shown in FIG. 23, the transmit-receive circuit 97 may be shared among the antennas 96. However, the transmit-receive circuit 97 may be provided separately for each antenna 96.

Communicating Operation

Figure 24:
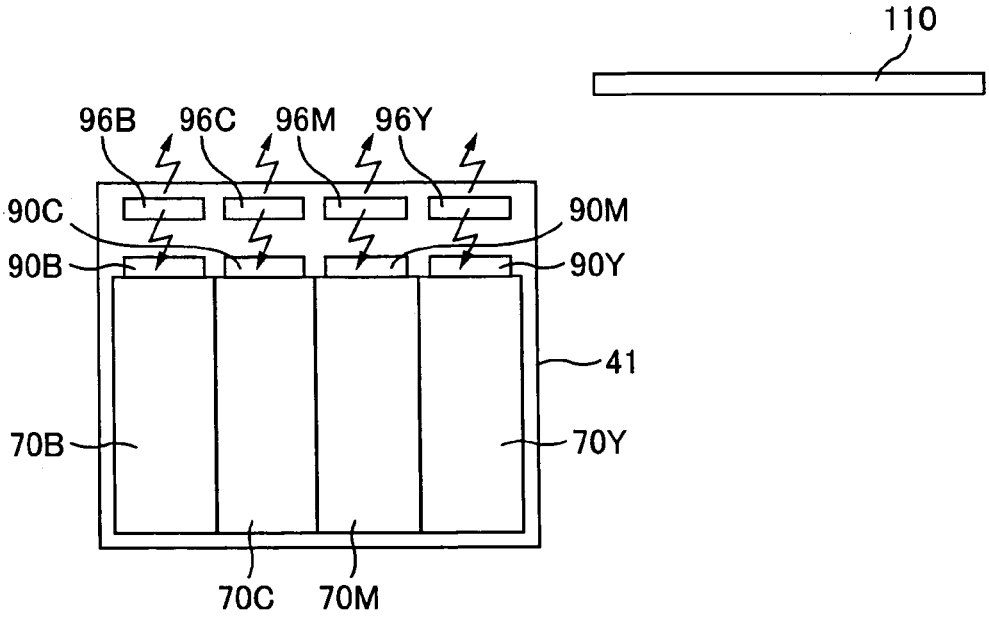
FIG. 24 is an explanatory diagram of a communicating operation in the present embodiment, and is an explanatory diagram showing a state in which the antenna cannot communicate with a memory card.
Figure 25:
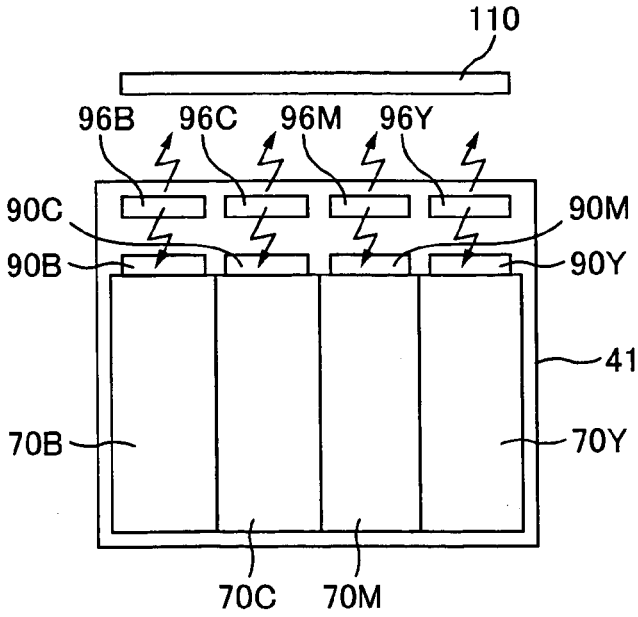
FIG. 25 is an explanatory diagram of a communicating operation in the present embodiment, and is an explanatory diagram showing a state in which the antenna can communicate with the memory card.

Using FIG. 24 and FIG. 25, the communicating operation is explained. Note that, FIG. 24 is an explanatory diagram showing a state in which the antennas 96B to 96Y cannot communicate with the memory card 110. Further, FIG. 25 is an explanatory diagram showing a state in which the antennas 96 can communicate with the memory card 110. Note that, in these figures, the structural components which have already been explained accompany the same reference characters, and therefore, explanation is omitted. Note that, by inserting the memory card 110 into the slot 100, it becomes parallel with the antennas 96B to 96Y. Further, the antennas 96B to 96Y are provided on the lid of the carriage 41, and are therefore movable in the scanning direction together with the carriage 41.

In FIG. 24, the carriage 41 is positioned so that the antennas 96B to 96Y are in a position distant from the memory card 110. In this state, even if the antennas 96B to 96Y generate a magnetic field to communicate wirelessly, the antennas 96B to 96Y can only communicate with the storage units 90B to 90Y, and cannot communicate with the memory card 110.

On the other hand, in FIG. 25, the carriage 41 is positioned so that the memory card faces the carriage above the antennas 96B to 96Y. That is, in this state, the antennas 96 are positioned between the storage units 90 and the slot 100 (that is, the memory card 110). In this state, when the antennas 96 generate a magnetic field to communicate wirelessly, it is possible to communicate both with the storage units 90 and the memory card 110 at the same time.

In the state of FIG. 25, when the antennas 96 try to communicate with the storage units 90, a magnetic field is generated also on the memory card 110 side, and therefore, signal collision becomes a problem. Therefore, when communication is to be carried out in this state, an identifier (for example, ID information) is included in the signal to be communicated to thereby avoid signal collision.

By the way, with the antenna of this embodiment, it is possible for a single antenna to face both the storage unit 90 and the memory card 110, and therefore, the number of antennas can be reduced, and manufacturing costs can be reduced.

Modified Example of Second Embodiment

In the foregoing, a printer, for example, according to the present invention was described based on the second embodiment. However, the foregoing embodiment is for the purpose of elucidating the present invention and is not to be interpreted as limiting the present invention. The invention can of course be altered and improved without departing from the gist thereof and includes equivalents thereof. In particular, the printing apparatus according to the invention includes the embodiments mentioned below as well.

<About the Arrangement of Antennas>

According to the above-described embodiment, a plurality of antennas are provided facing the cartridges for each color. However, the arrangement of the antennas is not limited thereto.

Figure 26:
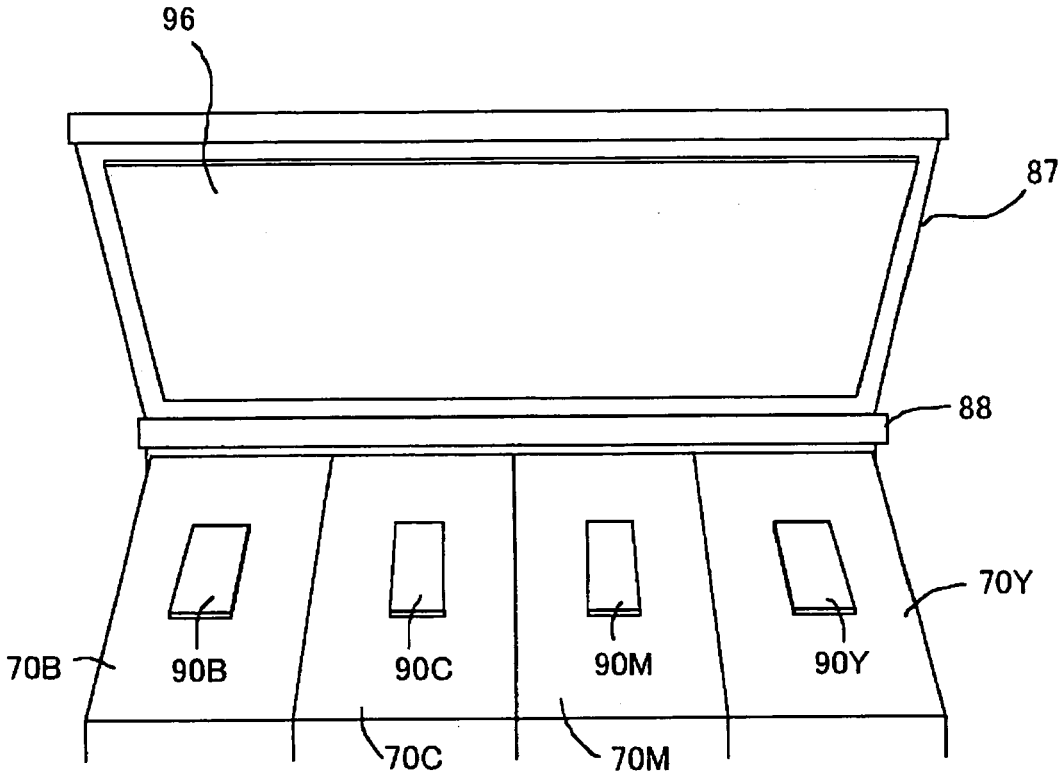
FIG. 26 is an explanatory diagram of a positional relationship between an antenna and storage units according to another embodiment.
Figure 27:
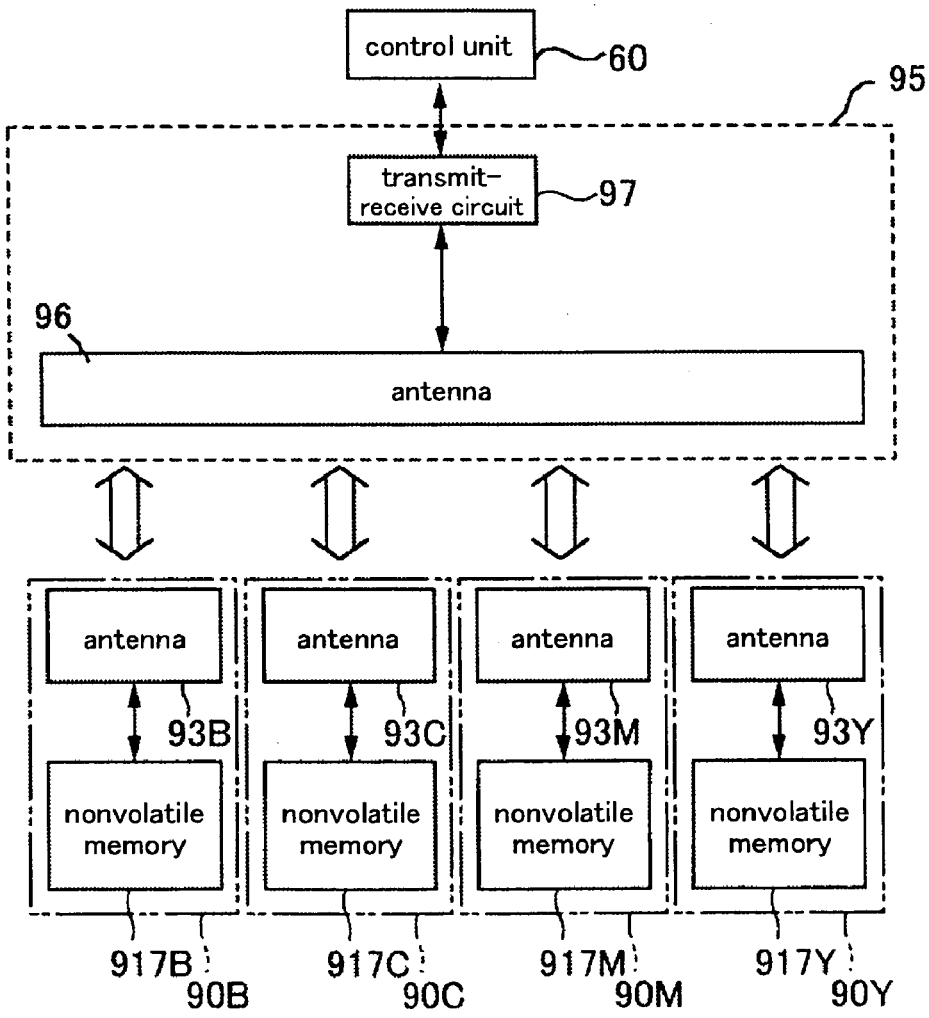
FIG. 27 is an explanatory diagram of a transmit-receive section in the case of FIG. 26.

FIG. 26 is an explanatory diagram of the positional relationship between the antenna 96 and the storage units 90 according to another embodiment. Further, FIG. 27 is an explanatory diagram of a transmit-receive section for when the antenna is arranged as in FIG. 26. In these figures, the same reference characters are assigned to the same structural components, and therefore, explanation is omitted. Note that, the antenna 96 of this embodiment differs from the antenna of the foregoing embodiment in terms that it is capable of communicating wirelessly with a plurality of storage units.

According to this embodiment, since the antenna 96 can be made large, the signals to be transmitted and received can be made large, and thus the reliability of communication can be improved. Further, since the number of antennas can be decreased, the manufacturing costs can be reduced.

Note that, when the antenna 96 is shared among the plurality of storage units 90 as in this embodiment, signal collision becomes a problem. Therefore, if the structure of this embodiment is employed, then ID information is included in the signals to be communicated in order for the antenna 96 to be able to communicate with an arbitrary storage unit 90, thus allowing prevention of signal collision.

<About the Cartridges>

According to the above-described embodiment, an ink cartridge is provided for each color. However, the configuration of the cartridge is not limited thereto.

Figure 28:
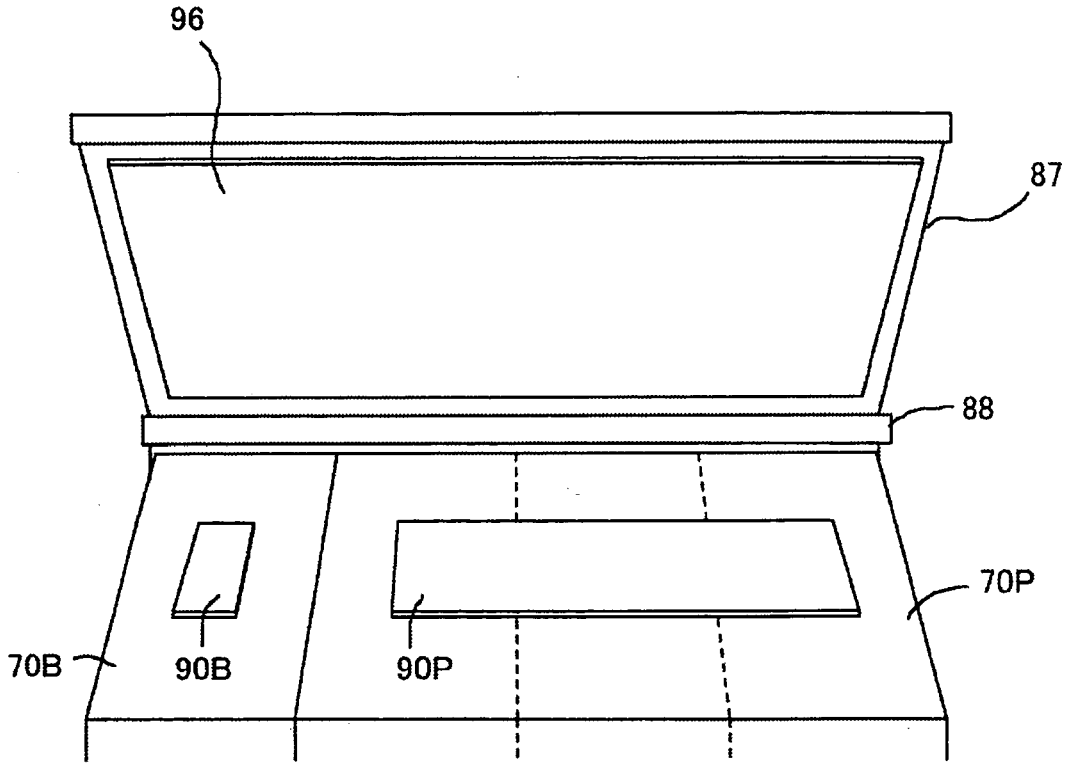
FIG. 28 is an explanatory diagram of a positional relationship between an antenna and storage units according to another embodiment.

FIG. 28 is an explanatory diagram of the positional relationship between the antenna 96 and the storage units 90 of another embodiment. In this figure, the same reference characters are assigned to the same structural components, and therefore, explanation is omitted. Note that, in this embodiment, a plurality of cartridges (70C, 70M, and 70Y), which were provided for each color in the foregoing embodiment, are combined into a single color cartridge 70P.

The color cartridge 70P has a plurality of ink containing sections inside, and contains ink of a plurality of colors. The upper surface of the color cartridge 70P is provided with one storage unit 90P. A memory cell that the storage unit 90P has stores information about ink for each color.

According to this embodiment, since the antenna 93 of the storage unit 90P can be made large, the signals that are transmitted and received can be made large, thus reliability of communication can be improved.

<About the Arrangement of Storage Unit>

According to the above-described embodiment, the storage unit 90 is provided on the upper surface of the cartridge 70. However, the arrangement of the storage unit 90 is not limited thereto.

Figure 29:
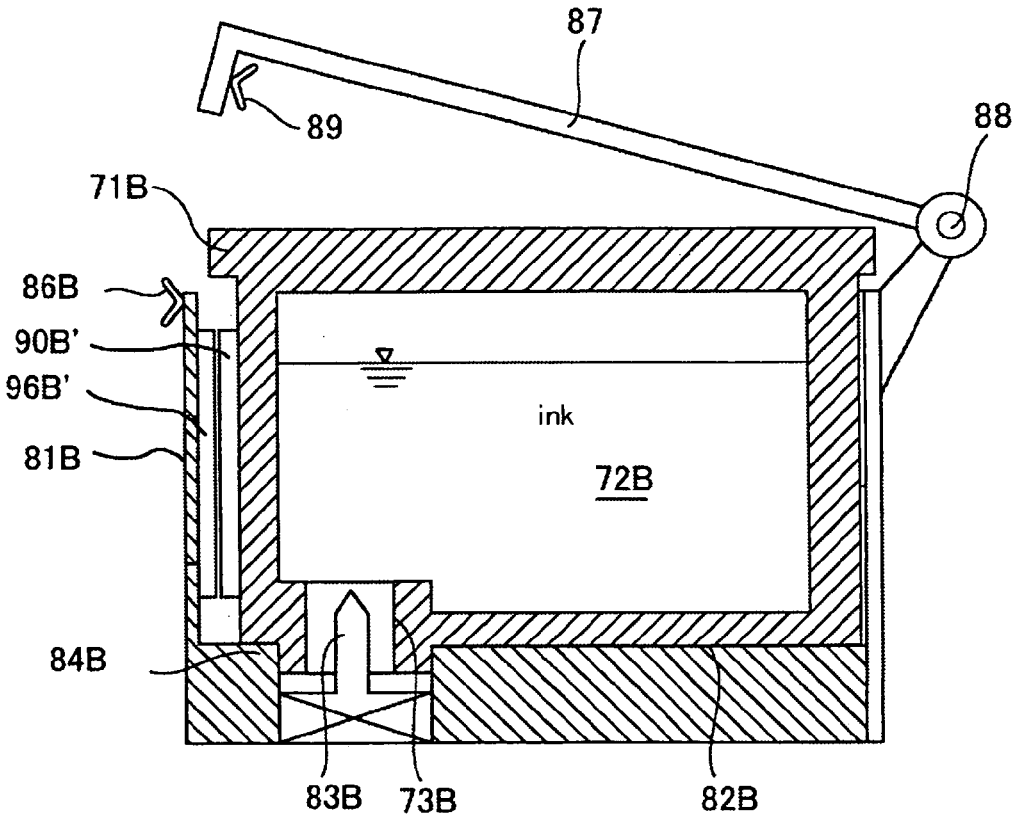
FIG. 29 is an explanatory diagram of an arrangement of a storage unit and an arrangement of an antenna according to another embodiment.

FIG. 29 is an explanatory diagram of another embodiment regarding the arrangement of the storage unit 90 and the arrangement of the antenna 96. In this figure, the same reference characters are assigned to the same structural components, and therefore, explanation is omitted. Note that, this embodiment is different from the foregoing embodiment in terms that the storage unit 90 is provided on a side surface of the cartridge.

In this figure, 90' is a storage unit provided on a side surface of black ink cartridge 70B. Further, 96' is an antenna provided on the inner wall of the attach/detach section of the carriage 41.

Even with this embodiment, the storage unit 90' and the antenna 96 can be provided facing each other. Further, the storage unit 90' and the antenna 96' are drawn separated from each other in this figure; however, a film of the storage unit 90' and a film of the antenna 96' may be in a state in which they are in contact with each other, as with the foregoing embodiment.

Even with this arrangement, an effect similar to the foregoing embodiment can be obtained.

<About the Nozzles>

According to the above-described embodiment, the nozzles are provided in the head 21 and the head 21 is provided on the carriage 41, and thus the nozzles were provided integrally with the carriage 41. However, the configuration of the nozzles and the head 21 is not limited to this. For example, the nozzles or the head may be provided integrally with the cartridge and be attachable and detachable to and from the carriage 41.

<About the Ink>

According to the above-described embodiment, the cartridge is the ink container which contains ink. However, the cartridge is not limited thereto. For example, the cartridge may be a toner container containing toner. Further, in this case, the cartridge, which is the toner container, may comprise a developer roller.

Note that in this case, since it is normal for the printing apparatus to comprise a rotary to and from which a plurality of cartridges can be attached and detached, the antenna would be provided on this rotary. The antenna provided on the rotary will carry out wireless communication with the storage unit provided on the cartridge.

Industrial Applicability (1) According to the first invention, it becomes possible to effectively utilizes the antenna of a printing apparatus having an antenna that is capable of communicating wirelessly with an element (for example, a storage unit having a memory) provided on an ink container (for example, a cartridge).

(2) According to the second invention, it becomes possible to provide a power-conserving printer by establishing a state in which communication is possible even with a weak radio wave.

The invention claimed is:

1. A printing apparatus comprising:

an antenna for communicating wirelessly with an element that is provided on an ink container;

an attach/detach section to and from which a storage medium can be attached and detached; and a unit for preventing clogging of nozzles that eject ink, wherein:

said antenna is a flat antenna;

said antenna is capable of communicating wirelessly with said storage medium attached to said attach/detach section;

said storage medium is parallel to said antenna when said storage medium is attached to said attach/detach section;

one side of said antenna faces said element;

a side opposite from said one side of said antenna faces a storage medium attached to said attach/detach section; and said antenna is provided above said unit, and said antenna communicates with said element during operation of said unit to prevent clogging in said nozzles.

2. A printing apparatus according to claim 1, wherein said antenna is provided on a lid which is opened and closed when said ink container is exchanged.

3. A printing apparatus according to claim 2, wherein said attach/detach section is provided on said lid.

4. A printing apparatus according to claim 2, wherein the material of said lid is a nonmagnetic material.

5. A printing apparatus according to claim 1, wherein said attach/detach section is a nonmagnetic material.

6. A printing apparatus according to claim 1, wherein said attach/detach section restricts the position of said storage medium.

7. A printing apparatus according to claim 1, wherein said attach/detach section is a slot for inserting said storage medium.

8. A printing apparatus according to claim 1, wherein said antenna communicates information about an amount of ink to said element.

9. A printing apparatus according to claim 1, wherein said antenna communicates information about a medium to be printed with said storage medium.

10. A printing apparatus according to claim 9, wherein:

said storage medium is packaged together with said medium to be printed; and when said printing apparatus prints on said medium to be printed, said storage medium is taken out independently of said medium to be printed and attached to said attach/detach section.

11. A printing apparatus according to claim 9, wherein said antenna communicates, with said storage medium, information about a location where driver information for said medium to be printed can be downloaded from.

12. A printing system comprising:

a computer; and a printing apparatus that is connected to said computer and that includes:

an antenna for communicating wirelessly with an element that is provided on an ink container;

an attach/detach section to and from which a storage medium can be attached and detached; and a unit for preventing clogging of nozzles that eject ink, wherein:

said antenna is a flat antenna;

said antenna is capable of communicating wirelessly with said storage medium attached to said attach/detach section;

said medium is parallel to said antenna when said storage medium is attached to said attach/detach section;

one side of said antenna faces said element;

a side opposite from said one side of said antenna faces a storage medium attached to said attach/detach section; and said antenna is provided above said unit, and said antenna communicates with said element during operation of said unit to prevent clogging in said nozzles.

13. A printing apparatus comprising:

an antenna for communicating wirelessly wit an element that is provided on an ink container;

an attach/detach section to and from which a storage medium can be attached and detached; and a unit for preventing clogging of nozzles that eject ink, wherein:

said antenna is capable of communicating wirelessly with said storage medium attached to said attach/detach section;

one side of said antenna faces said element;

a side opposite from said one side of said antenna faces a storage medium attached to said attach/detach section; and said antenna is provided above said unit, and said antenna communicates with said element during operation of said unit to prevent clogging of nozzles.

* * * * *